US005579604A

United States Patent [19]

Holung et al.

[11] Patent Number: 5,579,604

[45] Date of Patent: Dec. 3, 1996

[54] STORM SHUTTER WITH ATTACHMENT FEATURE

[76] Inventors: Joseph A. Holung, 3500 Tunis St., Raleigh, N.C. 27604; Jerry L. Leslie, 5351 NW. 77th Ct., Pompano Beach, Fla. 33073

[21] Appl. No.: 281,434

[22] Filed: Jul. 27, 1994

[51] Int. Cl.[6] ..... E05B 65/04

[52] U.S. Cl. ..... 49/61; 49/465; 52/202

[58] Field of Search ..... 49/61, 62, 50, 49/55, 57, 463, 465; 52/202, 203, 507

[56] References Cited

U.S. PATENT DOCUMENTS

| | | | |
|---|---|---|---|
| 1,055,127 | 3/1913 | Boger . | |
| 1,340,084 | 5/1920 | Seifert . | |
| 1,590,394 | 6/1926 | Rawlings . | |
| 1,659,989 | 2/1928 | Simpson . | |
| 1,887,365 | 11/1932 | Wegner . | |
| 2,210,624 | 8/1940 | Kramer | 156/15 |
| 2,316,688 | 4/1943 | Haase | 49/465 X |
| 2,349,470 | 5/1944 | Stanfield | 189/63 |
| 3,000,063 | 9/1961 | Hoog | 49/465 X |
| 3,913,971 | 10/1975 | Green | 49/465 X |
| 3,987,596 | 10/1976 | Wolf | 49/465 X |
| 4,149,342 | 4/1979 | Bowers | 49/55 |
| 4,203,256 | 5/1980 | Mowry | 49/465 |
| 4,848,034 | 7/1989 | Pace | 49/465 |
| 4,964,755 | 10/1990 | Lewis et al. | 49/465 X |
| 5,048,239 | 9/1991 | Filitz et al. | 49/465 X |
| 5,131,186 | 7/1992 | Comont | 49/465 X |
| 5,283,979 | 2/1994 | Carlson et al. | 49/465 X |

*Primary Examiner*—Jerry Redman
*Attorney, Agent, or Firm*—Ronald V. Davidge

[57] ABSTRACT

A shutter is provided for attachment to window opening surfaces extending inward from a wall surface of a building. Mechanisms are provided to allow both the installation and removal of the shutter from outside the building. In a first version, a clamping mechanism feeds a bar into engagement with a surface of the window opening. The bar remains in engagement with this surface until a release mechanism is operated. In another version, a drive screw moves a compressible foot into and out of contact with the window opening surface. In yet another version, a toggle mechanism operates in such a way that increased engagement of an engagement surface increases the resistance to disengagement as the shutter is pulled away from the window.

27 Claims, 15 Drawing Sheets

STORM SHUTTER WITH ATTACHMENT FEATURE

BACKGROUND OF THE INVENTION

1. Field of the Invention

This invention relates to shutters for temporary application to windows to prevent damage by flying debris, and more particularly, to a means providing for such attachment without modifications to the structure of a building.

2. Background Information

In the event of an oncoming windstorm, many individuals place external covers, or shutters over windows to prevent the damage which may otherwise be caused by flying debris. Such shutters are generally either of a relatively complex and expensive type formed as a permanent though movable portion of the building structure, or of a simple type fastened in place to the outside of the building structure.

An example of the relatively complex type of shutter is provided by a rolling shutter formed as a number of hinged slats to be rolled into a generally cylindrical shape at the top of the window, exposing the window, and to be pulled downward in slots at either side of the window, covering the window. Another example of the relatively complex type is provided by an awning pivotally mounted along an axis extending across the top of the window. Such an awning can be pivoted between an outward-extending open position, and a closed position, in which the awning extends downward over the window, and can be latched in place in either of these positions.

An advantage of these relatively complex types of shutters is the ease with which they may be moved between open and closed positions. Disadvantages include their relatively high initial cost, the complexity of the structural provisions which must be made for their mounting to a building, and the fact that individual shutters must be sized for individual windows. While this method provides the user with an easily-operable system for the movement of shutters between open and closed positions, and for latching shutters closed, the hardware provided for such functions is integrated into the shutters in such a way that it cannot be readily used to provide protection for another window, or for a different size window. While shutters of this type can be easily closed upon receiving news of an approaching storm, they can seldom if ever be installed upon receiving such news. Furthermore, the bulky presence of such shutters under normal, non-storm conditions may be considered a disadvantage.

An example of a relatively simple type of shutter is provided by a sheet of plywood fastened in place over the outside surface of a window upon receiving news of an approaching storm. A particular advantage of this kind of shutter is its low initial cost. However, the use of this type of shutter to secure a building is usually particularly difficult due to the popularity of masonry construction, which fails to provide a wood frame suitable for nailing a shutter in place over a window. In most modern buildings, special bolts must be driven into holes in the masonry surface around the window, after these holes are drilled using a special masonry drill. While this process is superficially simple, it is difficult and time-consuming, particularly when performed in the face of an approaching storm. Furthermore, the holes remaining in the building after the shutters are removed are often objectionable.

Thus, the customary methods of providing storm shutter protection, by means of both the relatively simple and relatively complex types of shutters, share the disadvantage of requiring modification to the structure of the building, whether such modifications include the mounting of tracks and pivots or the drilling of numerous holes in exterior masonry surfaces.

Therefore, what is needed is a type of shutter which can be readily applied over windows in a wide variety of applications without requiring the drilling of holes for mounting. It is also desirable that a shutter be easily and completely removable for storage during non-storm conditions and that such a shutter may be easily installed upon receiving news of an approaching storm. While variations in the size and shape of windows may require the use of varying sizes and shapes of covering materials, such as plywood, it is desirable that mechanisms provided to facilitate the installation and removal of shutters should be readily applicable to different sizes and shapes of covering materials.

3. Description of the Prior Art

The patent art describes bar arrangements which may be fastened in place to extend across all or part of a window opening. For example, U.S. Pat. No. 1,055,127 to Boger describes a bar arrangement which can be fastened in place within the channels extending along opposite sides of a vertically movable window. U.S. Pat. No. 4,149,342 to Bowers describes a pair of movable frame sections of a bar arrangement adapted for horizontal movement selectively between an inner retracted position and an outer extended position. The overall width of the bar arrangement is determined by the movement of a link pivotally mounted on one of the frame sections into one of a number of slots provided in the other of the frame sections. Four pointed projections secure the bar arrangement in place within a window opening in a building.

While the devices of Boger and Bowers provide a measure of projection against intruders, each being lockable in place with a padlock, a solid covering to prevent window damage during windstorms is not provided. With the device of Boger, the use of channels provided for window movement precludes the installation of the bar arrangement over a closed window. While the bar arrangements of these prior art devices can be assembled to accommodate different openings by varying in width, they are fixed in height.

U.S. Pat. No. 1,340,084 to Seifert describes a hinged door for filling an opening, in which the door consists of main and supplemental members. The supplemental member is carried by the main member, with both members being hollow and arranged in a telescoping relationship with each other. Means are provided to exert a pressure on the supplemental member from the main member, so that the supplemental member forms an air tight seal with the opening into which it is closed. In this way, an efficient method is provided for closing openings in refrigerators and refrigerating railroad cars. However, movement of the supplemental member is not used to hold the door in place, or closed. The movement of the supplemental member instead tends to push the main member open as the air tight seal is formed. Conventional hinges and latches are used to hold the main member in place and shut. The door becomes a permanent, though movable, portion of the structure to which it is attached. What is needed in a storm shutter application is a means to hold the door in place without relying on the external attachment of hinges and latches.

U.S. Pat. No. 2,349,470 to Stanfield and U.S. Pat. No. 2,210,624 to Kramer describe means for installing a blind arrangement inside the rear window of an automobile. A number of horizontal or angularly adjustable slats block sunlight while allowing rearward vision through the window. The arrangement is held in place by tips pressed into the rubber frame generally extending around the rear window of an automobile.

U.S. Pat. No. 1,659,898 to Simpson and U.S. Pat. No. 1,887,365 to Wegner describe adjustable rod mechanisms for holding a window or door in a desired position. The rod extends through a hole in a pivotable plate, and a compression spring extends around a part of the rod to hold the rod in place by pivoting the plate to clamp the rod. The rod is released by manually pivoting the plate against the pressure provided by the spring.

SUMMARY OF THE INVENTION

In accordance with one aspect of the invention, there is provided a shutter for covering a window opening extending inward from a wall surface. First and second window opening surfaces extending inward at opposite sides of the window opening. The shutter includes a nearly solid window covering structure extending across the window opening, having an inner side facing the window and an outward-facing outer side. The shutter also includes engagement mechanisms extending inward from the inner side to engage the first and second window opening surfaces. One of these engagement mechanisms, engaging the second window opening surface, includes a movable engagement device, which extends inside the inner side, to be moved through a variable distance into engagement with this window opening surface. Movement is imparted to the movable engagement device from outside the outer side. The movable engagement device is subsequently held in engagement with the second opening surface, as an engagement force is maintained between the movable engagement device and the second window opening surface. The movable engagement device may then be released from engagement with the second window opening surface from outside the outer side.

A storm shutter built in accordance with the present invention includes a window covering structure, which extends across a window opening, preferably overlapping a portion of the outer wall of a building on each side of the window opening. Structures to hold the shutter in place extend inward from the window covering structure, into the window opening. Surrounding physical features, such as a window ledge or a ground surface extending immediately below a window opening, may make it impossible to overlap the outer wall on each side of the window opening. A clamping mechanism extends inside the window covering structure to engage a surface of the window opening while a block engages the side of the window opening opposite the side engaged by the clamping mechanism. Using a clamping mechanism in this way eliminates a need to locate precisely attachment features of the shutter with respect to the window opening surfaces engaged to hold the shutter in place.

A storm shutter built in accordance with the present invention includes a clamping mechanism which can be engaged and disengaged from a window opening from outside the window covering structure. That is, if the shutter is installed from the outside of a structure, the clamping mechanism can be engaged and disengaged from outside the structure. This feature is particularly useful, since many windows cannot be opened, precluding the use of a shutter requiring access to the space between the window covering structure and the window during installation or removal of the shutter.

It is anticipated that a storm shutter built in accordance with the present invention will generally be installed from the outside a structure, protecting a glass window from breakage due to flying debris during a storm. Various figures referenced below show this type of installation, and the references including the terms "outside" and "inside" are made to this type of installation. Nevertheless, it is understood that such a storm shutter may alternately be installed within a window opening inside a structure to protect the contents of the structure from flying glass and debris associated with breakage of the window, while remaining within the scope of this invention.

A primary advantage of a storm shutter built in accordance with the present invention, when compared to the background art, is the ability to install and remove the storm shutter without making modifications to the building structure. Thus, for example, it is not necessary to drill holes in the building structure. This advantage is valuable, both because damage to the structure during the installation process is thus avoided, and because a need to perform a difficult drilling operation, such as drilling through masonry, is avoided. Nevertheless, it is anticipated that some window opening will include notches, ledges, and the like, which may be used to advantage in the installation of a storm shutter built in accordance with the present invention. It is further understood that it may be desirable to perform modifications, such as the drilling of holes, to facilitate the installation of a storm shutter built in accordance with the present invention in certain window openings lacking surfaces suitable for engagement with the clamping surfaces of the storm shutter.

BRIEF DESCRIPTION OF THE DRAWINGS

Preferred embodiments of the subject invention are hereafter described, with specific reference being made to the following Figures, in which.

DESCRIPTION OF THE PREFERRED EMBODIMENTS

Embodiments or versions of shutters built in accordance with the present invention may be divided into three major categories. A shutter within the first of these categories has a clamping mechanism in which a bar is driven by a bar driving mechanism, which is operable from outside the window coveting structure, to engage the adjacent window opening surface. The bar is subsequently held in engagement with this surface by means of a bar holding mechanism, which may be released from outside the window covering structure. A shutter within the second of these categories has a clamping bar which is driven into and out of engagement with the adjacent window opening surface by-means of a drive screw, which is turned from outside the window covering structures. A shutter within the third of these categories has a clamping mechanism in which a toggle arm is brought into position with the engagement of the window opening surface in such a way that pulling end of the shutter fastened using the clamping mechanism outward, away from the window opening surface, results in the toggle arm being driven past an over center position at which energy storage within the mechanism is maximized.

Various versions or embodiments of the present invention will now be discussed in the general order described above. That is, a discussion of examples from the first category will be followed by a discussion of examples from the second category, which in turn will be followed by a discussion of examples from the third category.

Figure 1:
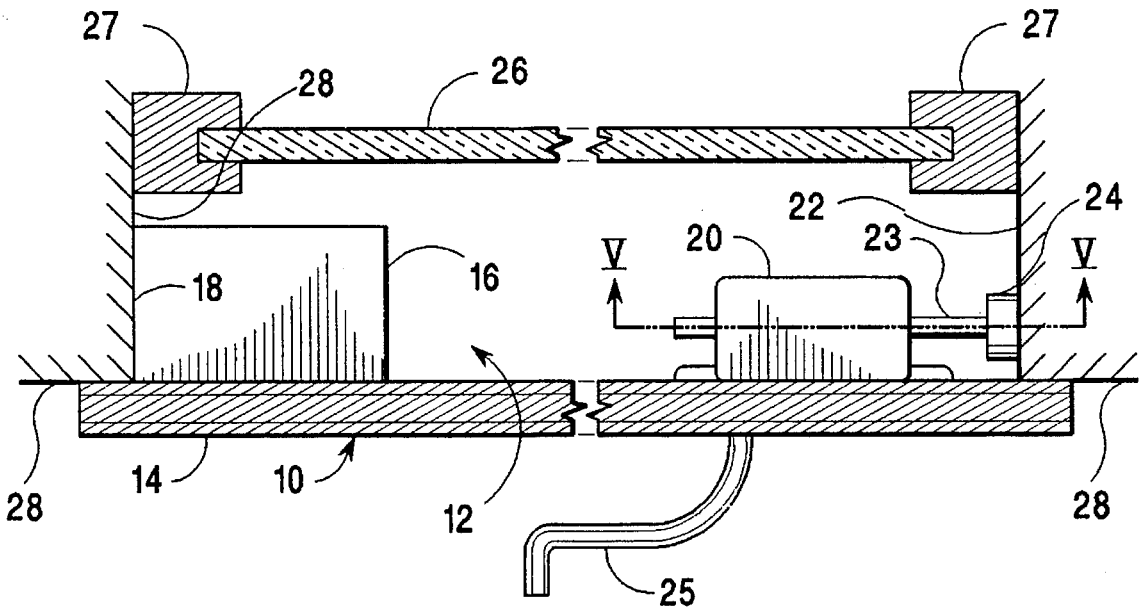
FIG. 1 is a partly cross-sectional plan view of a shutter built in accordance with a first embodiment of the subject invention.

FIG. 1 is a partly cross-sectional plan view of a shutter built in accordance with a first embodiment of the subject invention. This shutter 10, configured for attachment to a window opening 12 of a modem building, includes a window covering structure 14, which may be composed of a plywood sheet, clamping blocks 16 engaging a first side 18 of window opening 12, and a clamping mechanism 20 engaging a second side 22 of window opening 12 by means of a movable bar 23. This bar 23 preferably has a compressible foot 24 composed, for example, of an elastomeric material. A removable crank 25, which, when attached, extends outward from the window covering structure 14, is used to operate clamping mechanism 20 to power the engagement and disengagement of the movable bar 23 from second side 22. While a window 26 and a window mounting frame 27 are not contacted in the process of attaching shutter 10, window covering structure 14 is preferably held against outer wall surfaces 28 extending away from window opening 12.

Figure 2:
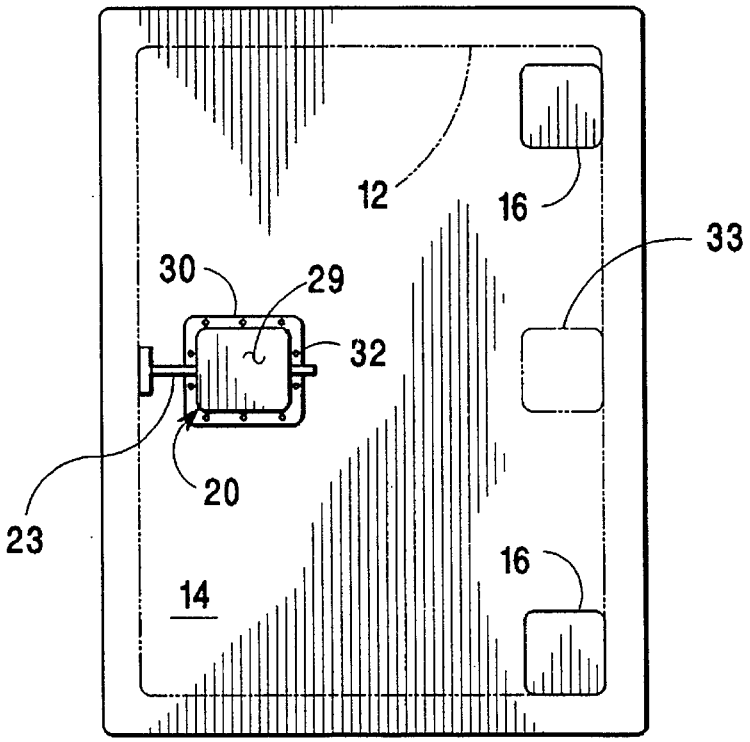
FIG. 2 is a rear elevational view of the shutter of FIG. 1.

FIG. 2 is a rear elevational view of the shutter 10. Clamping mechanism 20 is generally enclosed in a housing 29 having a flange 30 mounted to Window covering structure 14 by means of a number of screws 32. A phantom line represents the location of window opening 12 when this shutter 10 is installed within the opening. While window covering structure 14 preferably overextends window housing 12 on each side, a precise fit between the edges of structure 14 and opening 12 is not required for proper function. A pair of clamping blocks 16 are fastened to window covering structure 14 in a spaced-apart relationship along a side of this structure opposite the side at which movable bar 23 extends. In this way, pressure is applied in three spaced-apart areas from within the window opening 12. Alternately a single clamping block 16 may be placed directly opposite movable bar 23, as shown by phantom lines 33. However, the use of two blocks 16 simplifies the installation of a relatively heavy shutter on a relatively large window by allowing the weight of the shutter to rest on the lower block before the clamping mechanism 20 is engaged.

Referring to FIGS. 1 and 2, shutter 10 is thus held in place by the application of pressure directly to the surfaces of window opening 12, which is typically a masonry structure in a modem building. The opposed nature of sides 18 and 22 allow the application of considerable force in this way without requiring the establishment of new features, such as holes for mounting studs. This method works equally well if, for example, window opening 12 is part of an enlarged wooden or metal frame. Because reliance is not placed on attachment to channels or other features of window mounting frame 27, this method may be used equally well to protect a large variety of window types, such as stationary windows mounted in unmovable frames, casement windows mounted to slide in tracks, or awning windows pivoting outward to open. In this regard, this method of attachment provides a significant advantage when compared to prior-art methods for mounting structures across windows using particular features of window mounting frames, as described, for example, in U.S. Pat. Nos. 1,055,127, 2,210,624, and 2,239,470.

Figure 3:
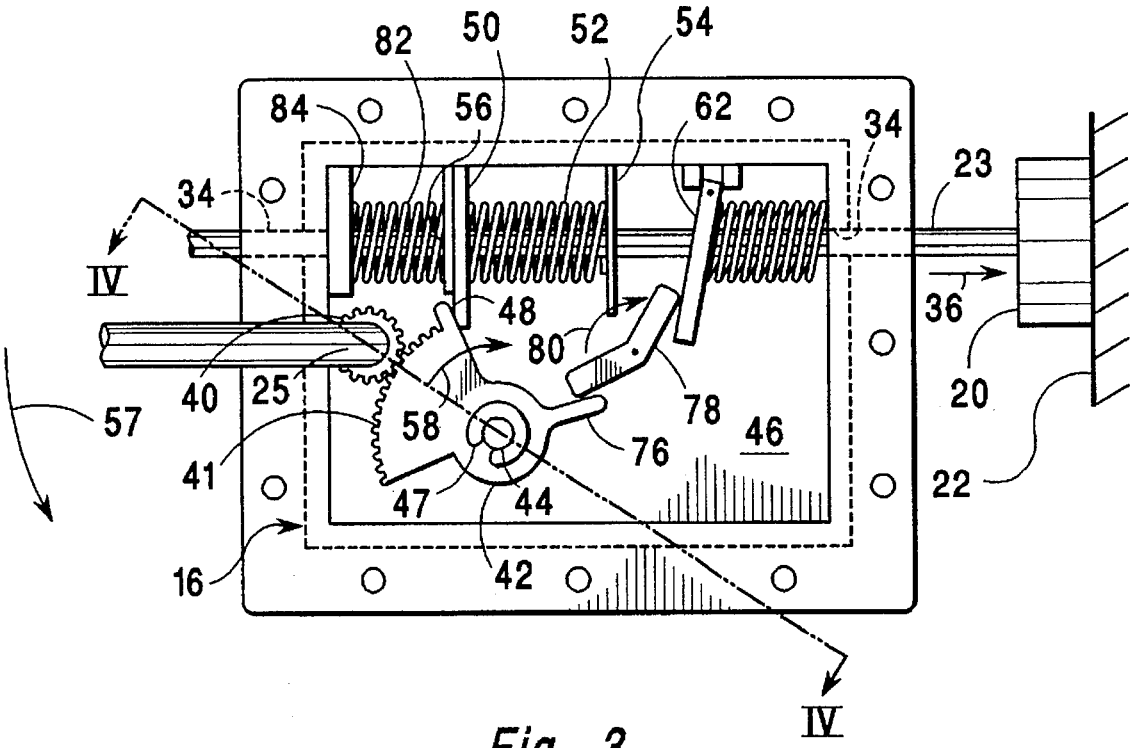
FIG. 3 is a front elevational view of a clamping mechanism in the shutter of FIG. 1, used to clamp the shutter within a window opening by driving a bar against a side of the window opening.

FIG. 3 is a front elevational view of clamping mechanism 20, removed from window covering structure 14 to reveal various internal components. Movable bar 23 is constrained to slide in a pair of holes 34 within housing 29, in the direction of arrow 36 to engage second window opening side 22 (shown in FIG. 1), and in the direction opposite arrow 36 to disengage this window opening side 22.

Figure 4:
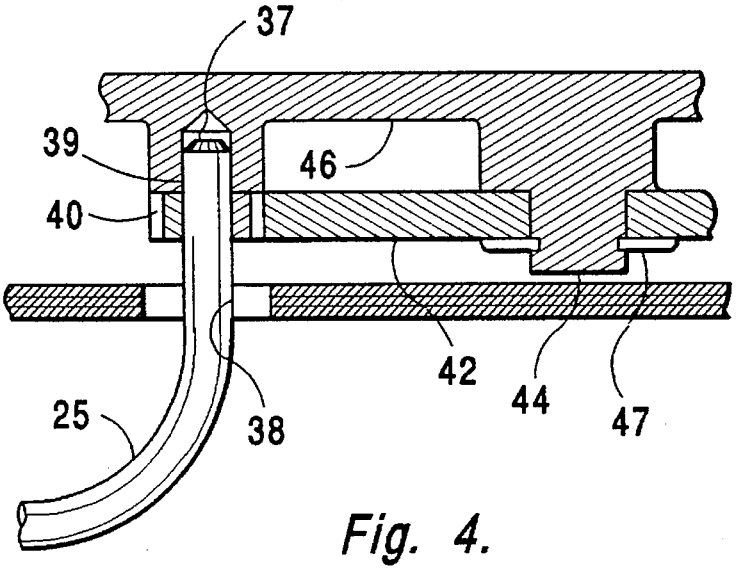
FIG. 4 is a cross-sectional elevation of a crank mechanism for manually operating the clamping mechanism of FIG. 3, taken as indicated by section lines IV—IV in FIG. 3.

FIG. 4 is a cross-sectional view, taken in the direction of section lines IV—IV in FIG. 3, showing the crank mechanism used for manual operation of the clamping mechanism 20. When a tip 37 of removable crank 25 is manually inserted through crank access hole 38, within window covering structure 14, into crank support hole 39 within housing 29, a drive gear 40, forming a portion of crank 25 near the tip 37, engages a sector gear 41 forming part of drive crank 42, which is mounted on a pivot 44 extending from a rear wall 46 of housing 29. A clip 47 is provided to hold drive crank 42 on pivot 44.

Referring again to FIG. 3, the tip of drive arm 48 of drive crank 42 engages a drive plate 50, which is assembled over movable bar 23. A crank return spring 52 is held in compression between drive plate 50 and a first inner wail 54 of housing 29. When no external force is applied to drive crank 42 by means of removable crank 25, crank return spring 52 holds drive plate 50 to the left, in the direction opposite arrow 36, against a second inner wail 56 provided as a part of housing 29. In this way, drive crank 42 is held in the position shown in FIG. 3 by the application of force from drive plate 50 to drive arm 48. In the operation of clamping mechanism 20 to clamp shutter 10 in place within window opening 12, an external torque is applied by moving crank 25 in the direction of arrow 57 to move drive crank 42 in the direction of arrow 58.

Figure 5:
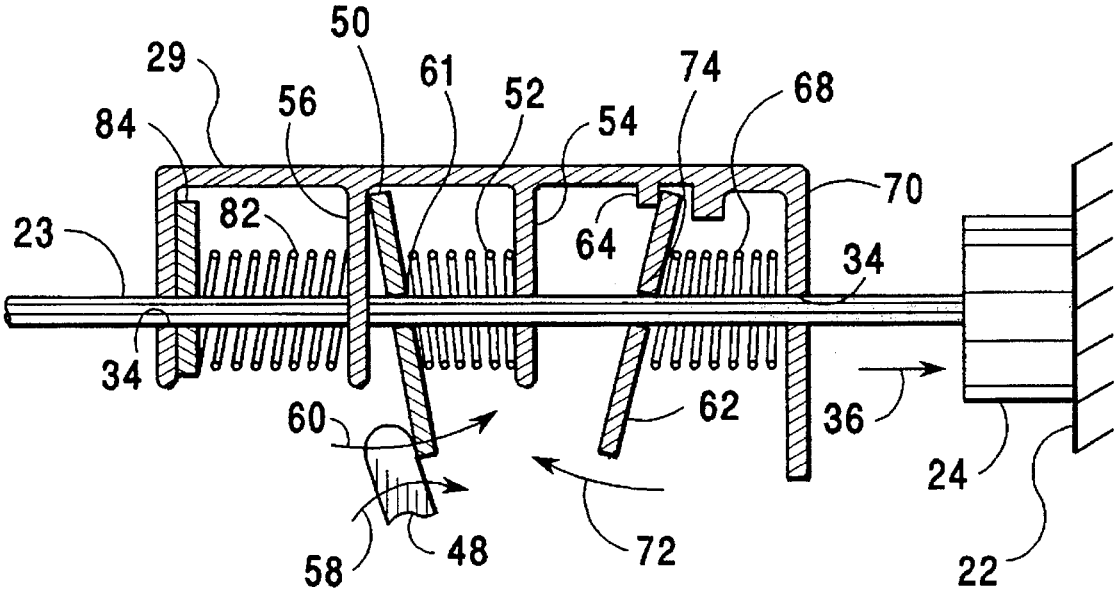
FIG. 5 is a cross-sectional front elevation of a portion of the clamping mechanism of FIG. 3, taken as indicated by section lines V—V in FIG. 1, showing in particular components used to move the bar and to hold it in place.

FIG. 5 is a front cross-sectional elevation, taken through the center of bar 23, as indicated by section lines V—V in FIG. 1, showing particularly the components used to move bar 23 and to hold it in place. Crank return compression spring 52 applies a force in the direction opposite arrow 36. Acting against this force supplied by compression spring 52, the force applied to a lower surface of drive plate 50 by tip portion 48 results in a torque turning plate 50 in the direction of arrow 60. After contact is made between an edge of the round hole 61 in plate 50 and the adjacent surfaces of bar 23, the additional application of torque to plate 50, as drive arm 48 moves in the direction of arrow 58 against the force provided by compression spring 52, causes the application of frictional forces between drive plate 50 and bar 23, resulting in the movement of bar 23 in the direction of arrow 36.

A clamping plate 62 is also assembled on bar 23, being held against a rib 64 of housing 29 by means of a clamping spring 68 compressed between this plate 62 and an end wail 70 of housing 29. In this way clamping plate 62 is mounted to pivot about the line along which it contacts rib 64, with the compression spring 68 applying a torque holding this plate 62 rotated in the direction of arrow 72 at an angle limited by contact between a hole 74 in plate 62, and bar 23 extending through the hole. The application of a force to bar 23 in the direction of arrow 36, as described in the preceding paragraph, results in the application of frictional forces also in the direction of arrow 36 to clamping plate 62 from bar 23. These frictional forces reduce the total torque acting in the direction of 72, causing bar 23 to be released, allowing movement of the bar in the direction of arrow 36. On the other hand, when a force is no longer applied to move the bar in the direction of arrow 36, the total torque applied to clamping plate 62 in the direction of arrow 72 returns to a level preventing the motion of bar 23 in the direction opposite arrow 36. In fact, an attempt to move bar 23 in the direction opposite arrow 36 increases the total torque applied to clamping plate 62 in the direction of arrow 72, causing an increase in the capability of plate 62 to prevent motion of the bar 23. Thus, the method which has been generally described in U.S. Pat. Nos. 1,659,898 and 1,887,365 is applied with bar motion being allowed in one direction and prevented in the other direction.

Referring again to FIG. 3, clamping plate 62 is released, allowing bar 23 to be returned opposite the direction of arrow 36 as drive crank 42 is rotated opposite the direction of arrow 58, so that the release arm 76 of drive crank 42 engages a lower surface of release crank 78. Further rotation of drive crank 42 opposite the direction arrow 58 causes the rotation of release arm 76 in the direction of arrow 80, moving the lower end of clamping plate 62 in the direction of arrow 36. In this way, the clamping grip of plate 62 on bar 23 is loosened, so that the bar may be returned in the direction opposite arrow 36. This return motion may be provided through the use of a bar return spring 82 compressed between second inner wall 56 and a fiat clip 84 snapped into a groove within bar 23 to move with the bar.

Referring to FIGS. 1, 3, and 4, the shutter 10 is installed in a window opening 12 by placing the shutter within the opening so that clamping blocks extend within the window opening along one side. This installation is begun with bar 23 in a retracted position (i.e. moved opposite the direction of arrow 36). Next, an end of removable crank 25 is inserted through access hole 38 in window covering structure 14. As crank tip 37 moves into crank support hole 39, drive gear 40 engages sector gear 41. While the shutter 10 is preferably supported with window coveting structure 14 held against outer wall surfaces 28, crank 25 is manually rotated in the direction of arrow 57, driving bar 23 from a retracted position into an extended position in engagement with second side 22 of window opening 12 as described above. At this point, crank 25 can be removed, as bar 23 is held in engagement with opening side 22 by clamping plate 62. The same crank 25 can be used to install a number of shutters 10 in this manner.

The shutter 10 is subsequently removed from window opening 12 by again inserting crank 25 into access hole 38 in window coveting structure 14, so that drive gear 40 engages sector gear 41 as crank tip 37 moves into crank support hole 39. Crank 25 is then manually turned in a direction opposite arrow 57, so that release crank 78 moves the lower end of clamping plate 62 to release bar 23. When this occurs, bar 23 is returned to its retracted position by bar return spring 82, out of contact with window opening 12, so that the shutter 10 can be pulled out of the opening.

As previously discussed, since this method of shutter installation and removal requires physical access only to the outside of the building, shutters of this kind can easily be installed over closed windows, including windows which cannot be opened and windows which cannot be shuttered when open because they open outward. Alternately, as discussed above, the shutter may be installed from inside a window opening.

The previous discussion has described the use of a gear-driven drive crank 42, which provides a mechanical advantage proportional to the ratio of the pitch radius of sector gear 41 over the pitch radius of drive gear 40. While this mechanical advantage may be used to facilitate the movement of bar 23 with relatively high levels of force to provide high frictional forces holding the shutter 10 within window opening 12, other methods, such as lengthening removable crank 25, may be used to facilitate providing sufficient levels of force.

Figure 6:
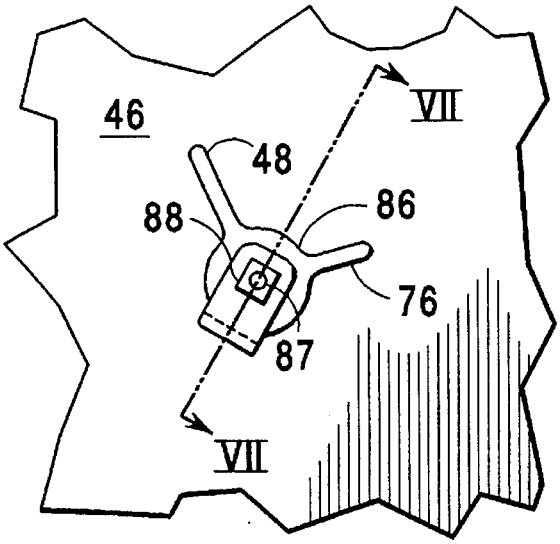
FIG. 6. is a front elevational view of an alternate crank mechanism for use as a part of the clamping mechanism of FIG. 3.
Figure 7:
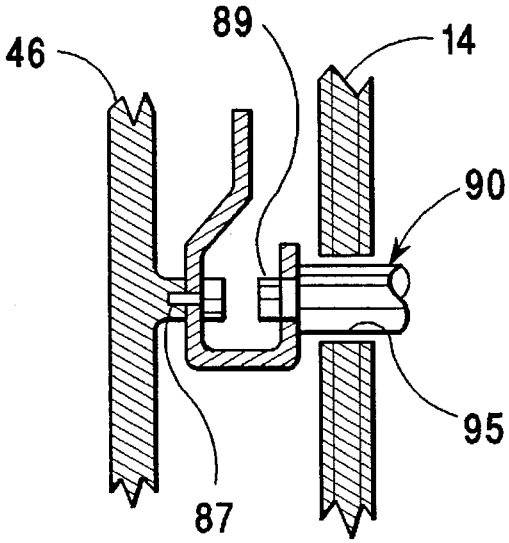
FIG. 7 is a cross-sectional elevation of the alternate crank mechanism of FIG. 6, taken as indicated by section lines VII—VII in FIG. 6.

FIGS. 6 and 7 show a crank-operated drive crank 86, which may be used as an alternative to the gear-operated drive crank 42, previously described in reference to FIGS. 3 and 4, in a somewhat different version of clamping mechanism 20. FIG. 6 is a front elevational view of the new drive crank 86, while FIG. 7 is a cross-sectional elevation taken as indicated by section line VII—VII in FIG. 6.

Referring to FIGS. 6 and 7, drive crank 86, which is pivotally mounted to rear wall 46 of housing 29 by means of a rivet 87, includes a non-circular aperture 88, into which a mating non-circular tip portion 89 of an alternative removable crank 90 is inserted to turn the drive crank 86. Drive crank 86 also includes a drive arm 48 and a release arm 76, which function as corresponding versions of these arms on drive crank 42, previously described in reference to FIG. 3. A drive hole 95 is included in window coveting structure 14 to allow access to aperture 88 with crank tip 89. In this way, the clamping mechanism is somewhat simplified at the expense of not providing the mechanical advantage available with the gear-driven version of FIGS. 3 and 4.

The previous discussion has described the use of a compressible foot 24 at the end of bar 23, allowing the storage of energy in such a way that pressure is maintained between the bar and the surface of window after the removal of a force to move the bar in the direction of arrow 36. It is alternately possible to configure a foot structure with a self-tightening mechanism, so that an attempt to pull the window coveting structure 14 away from the outer wall surfaces 28 results in increased pressure to hold the shutter 10 in place.

Figure 8:
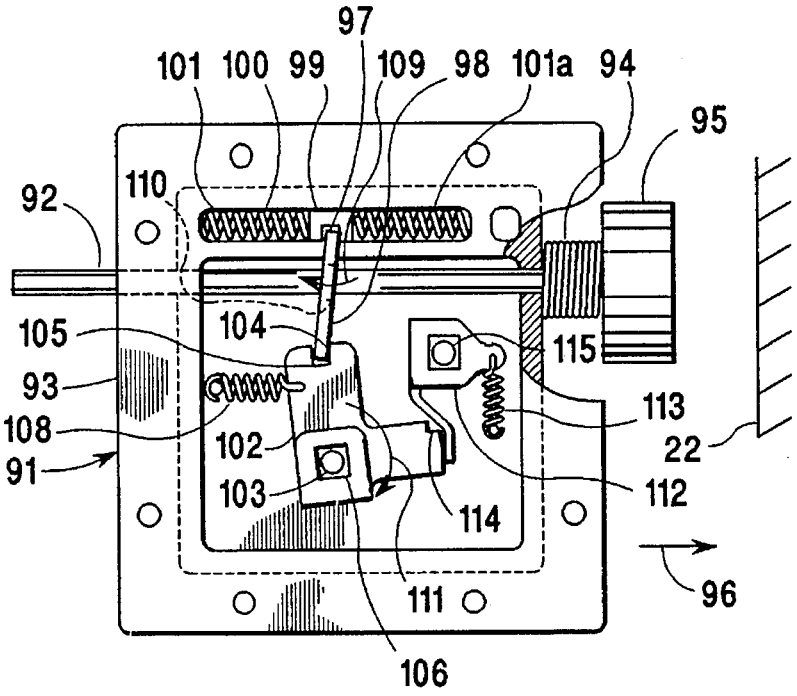
FIG. 8 is a front elevational view of a variation of the clamping mechanism of FIG. 3, shown with a movable bar fully retracted before installation into a window opening.
Figure 9:
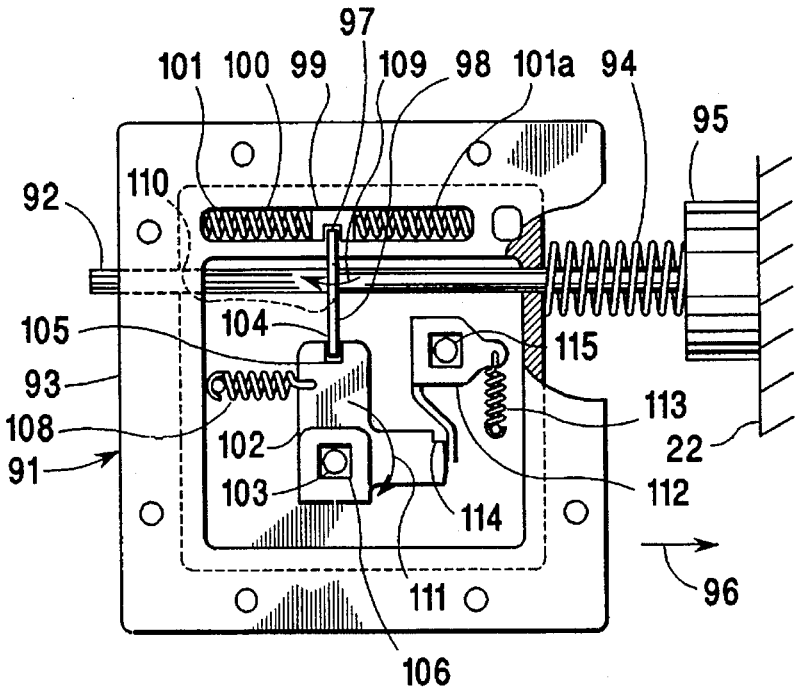
FIG. 9 is a front elevational view of the clamping mechanism of FIG. 8, shown with the movable bar initially extended into contact with a window opening surface.
Figure 10:
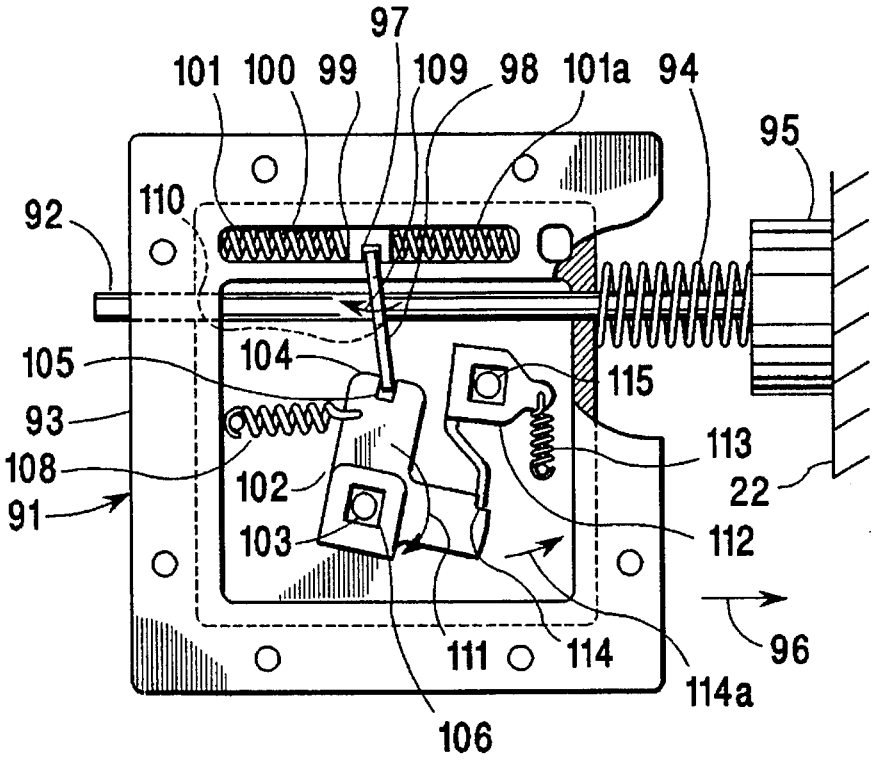
FIG. 10 is a front elevational view of the clamping mechanism of FIG. 8, shown with the application of a full engagement force between the movable bar and the window opening surface.

FIGS. 8, 9, and 10 are front elevational views of a variation of the clamping mechanism of FIG. 3. FIG. 8 shows this clamping mechanism 91 with movable bar 92 in a fully retracted position before installation into a suitable window opening. FIG. 9 shows this clamping mechanism 91 following the initial extension of movable bar 92 to engage a window opening surface 22. FIG. 10 shows this clamping mechanism 91 after the application of a full engagement force holding bar 92 against window opening surface 22. Clamping mechanism 91 is mounted on an associated widow covering structure (not shown) in the manner previously described in reference to FIG. 2.

Referring to FIG. 8, clamping mechanism 91 includes a housing 93 in which a movable bar 92 is slidably mounted. An external compression spring 94 pushes compressible foot 95 away from housing 93, moving bar 92 in the engagement direction of arrow 96. An upper end 97 of a clamping plate 98 is pivotally mounted in a block 99, which is in turn slidably mounted in a slot 100, being held centrally within this slot 100 by pivot centering springs 101 and 101*a*. A drive crank 102, pivotally mounted in housing 93 by a rivet 103, engages a lower end 104 of clamping plate 98 by means of a slot 105. A non-circular aperture 106 is used to engage drive crank 104 with a removable crank in the general manner described above in reference to FIGS. 6 and 7.

Before mechanism 91 is installed with an associated window covering structure (not shown), in a window opening, movable bar 92 is pushed inward, against the direction of arrow 96, compressing spring 94 to its minimum length. Spring 94 is weak enough to allow the shaft to be pushed inward by hand. An extension spring 108 pulls drive crank 102 to hold clamping plate 98 rotated in the direction of arrow 109, with movable bar 92 being held in place by friction at the edges of an aperture 110 in clamping plate 98, through which bar 92 passes. The force provided by extension spring 108 is great enough to hold bar 92 in this way, overcoming the force provided on the bar by the relatively weak compression spring 94.

Referring to FIG. 9, after mechanism 91 is installed with an associated window covering structure (not shown), in a window opening, drive crank 102 is rotated in the direction of arrow 111, using a removable crank 90 (shown in FIG. 7) to an intermediate position, pivoting clamping plate 98 in the direction opposite arrow 109, so that bar 92 is released to slide in the direction of arrow 96 by means of the force provided by compression spring 94. In this way a window opening surface 22 is initially engaged with compressible foot 95.

Referring to FIG. 10, continued rotation of drive crank 102 in the direction of arrow 111, pivots clamping plate 98 farther in the direction opposite arrow 109, to again clamp movable bar 92. After this occurs, additional rotation of drive crank 102 causes clamping plate 98 to slide in engagement with bar 92, in the direction of arrow 96, as block 99 slides against the force provided by centering spring 101*a* This motion compresses compressible foot 95, as force is stored to hold movable bar 92 engaged with window opening surface 22. As drive crank 102 is fully rotated in the direction of arrow 111, a holding pawl 112 is pulled, by a pawl spring 113, into engagement with a latching surface 114 of the drive crank 102. Holding pawl 112 is pivotally mounted to housing 93 by means of a rivet 115.

The process of disengaging movable bar 92 from window surface 22 is begun by rotating holding pawl 112, with removable crank 90 (shown in FIG. 7), in the direction of arrow 114*a* to disengage drive crank 102. At this point, spring 108 pulls drive crank 102 opposite the direction of arrow 111, pivoting clamping plate 98 in the direction of arrow 109, releasing and then re-engaging movable bar 92. Spring 101 returns block 99 to its central position within slot 100. Further movement of drive crank 102 opposite the direction of arrow 111 causes drive crank 102 to be slid opposite the direction of arrow 96 in engagement with bar 92, as block 99 moves opposite the direction of arrow 96 against the force provided by centering spring 101. In this way, bar 92 is moved opposite the direction of arrow 96, out of engagement with window surface 22.

Figure 11:
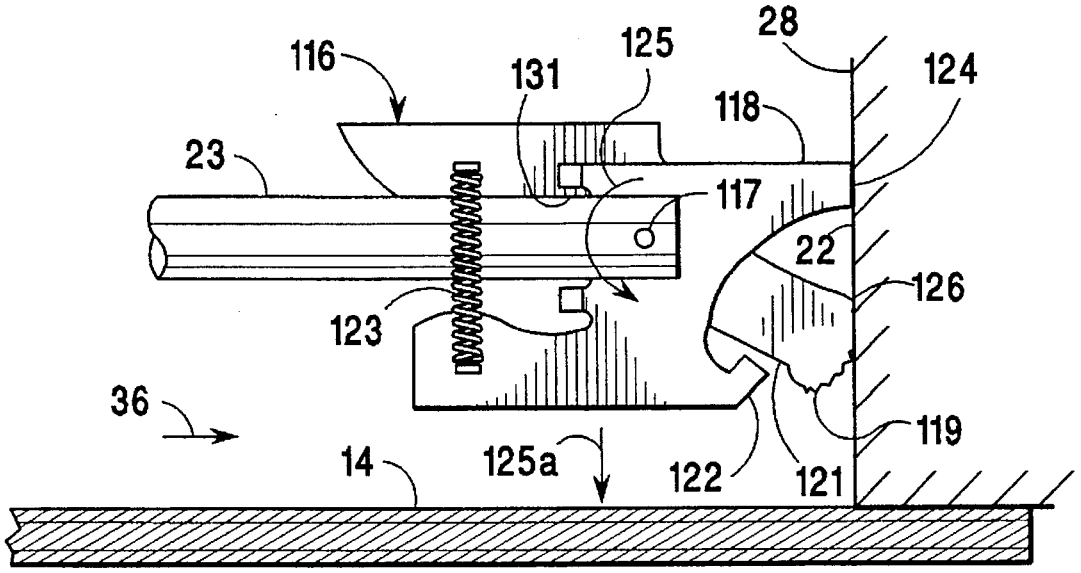
FIG. 11 is a plan view of an alternate foot including a cam-wedge self-tightening mechanism, attached to a proximal end of the bar of FIG. 3.

FIG. 11 is a plan view of an alternate foot structure 116 which may be attached to the proximal end of bar 23 to provide a self-tightening feature making the removal of window covering structure 14 from outer wall surfaces 28 especially difficult without first releasing clamping mechanism 20 to retract bar 23. The proximal end of bar 23 is fitted with a pivot 117, on which a stopping bracket 118 and a self-tightening shoe 119 are pivotally mounted. The pivoting motion of stopping bracket 118 is limited by a tab 120 extending upward along each side of the bar 23. In an absence of external forces, an edge 121 of self-tightening shoe 119 is held against a tab 122 of stopping bracket 118 by means of a compression spring 123. Thus, an alternate version of shutter 10 is clamped in place at a window opening 12 by bringing the alternate foot structure 116 into contact with side 22 of window opening 12, through movement of bar 23 in the direction of arrow 36, as described above in reference to FIGS. 3–5. If contact surface 124 of stopping bracket 118 makes first contact with window opening surface 22, a torque is developed about pivot 117 in the direction of arrow 125, bringing, causing a rotation of stopping bracket 118 and self-tightening shoe 119 to bring contact surface 126 of the shoe 119 also into contact with window opening surface 22. Similarly, if contact surface 126 makes first contact with window opening surface 22, a torque is developed about pivot 117 in the direction opposite arrow 125, causing a rotation of stopping bracket 118 and shoe 119 until bracket contact surface 124 also makes contact with surface 22.

If an attempt is made to move window covering structure 14 outward, in the direction of arrow 125*a*, as foot structure 116 is held in place in the direction of arrow 36, the friction forces developed between shoe contact surface 126 and window opening surface 22 create a torque tending to rotate shoe 119 in the direction of arrow 125. This torque is opposed by an increase in the normal force between shoe 119 and window opening surface 22. In this way, shoe 119 acts as a self-tightening component, through which forces tending to hold shutter 10 in place are increased if an attempt is made to remove it without releasing the clamping mechanism 20.

Figure 12:
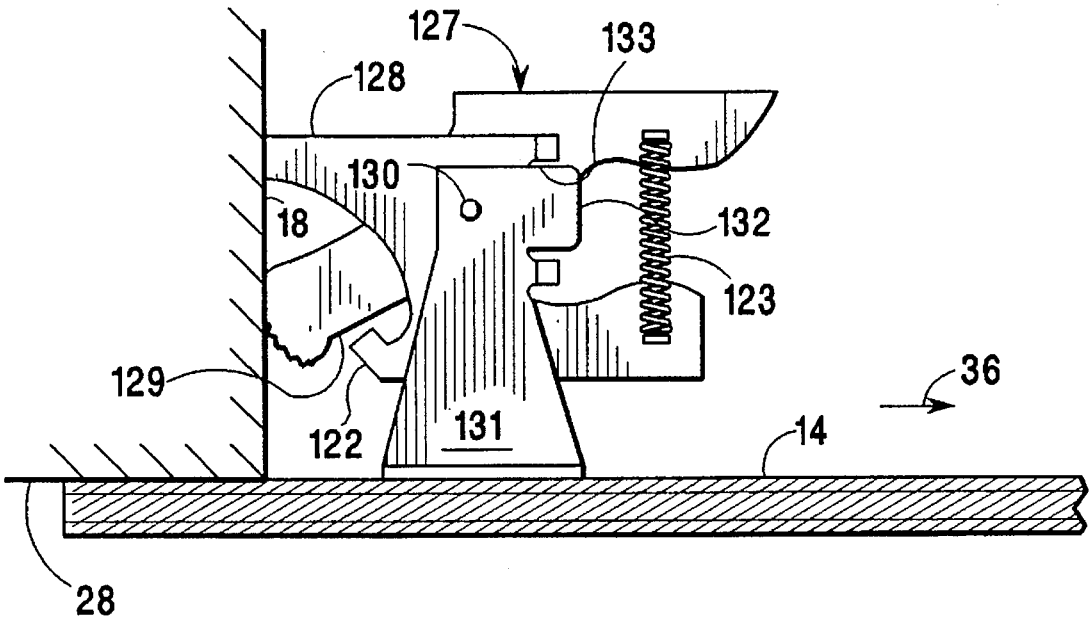
FIG. 12 is a plan view of a foot including a cam-wedge self-tightening mechanism attached to a side of the shutter of FIG. I opposite the proximal end of the bar of FIG. 3.

FIG. 12 is a plan view of an alternate foot structure 127, which is similar to the foot structure 116 described above in reference to FIG. 11, except that this foot structure 127 is configured particularly for attachment to window covering structure 14 at the side opposite the side at which the proximal end of bar 32 extends. In this application, the foot structure 127 may be used in adjacent cooperation with clamping blocks 16 (shown in FIG. 1) or in the replacement of these blocks 16. Foot structure 127 includes a stopping bracket 128 and a self-tightening shoe 129, both of which are attached to window covering structure 14 at a pivot 130 by means of an attachment bracket 131. Attachment bracket 131 includes a tab 132 extending through a slot 133 in stopping bracket 128 to limit the angular motion of this bracket 128 about pivot 130.

A particular advantage is gained when foot structures 116 and 127 are used together on opposite sides of the shutter 10. In this way, it becomes particularly difficult to pull the shutter outward, in the direction of arrow 125*a*, from either side. The strength formed in this way is particularly useful in preventing the removal of shutter 10 by wind forces during a storm.

Figure 13:
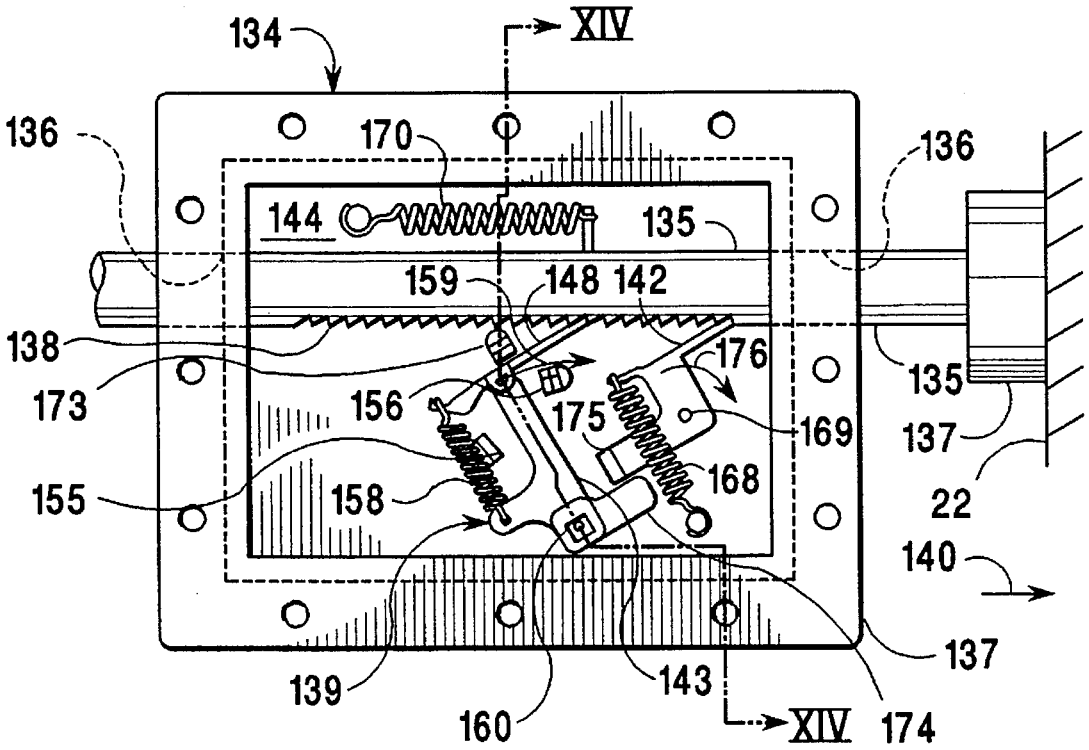
FIG. 13 is a front elevational view of a first alternate clamping mechanism for a shutter.

FIG. 13 is a front elevational view of an alternative clamping mechanism 134 for a shutter. A bar 135, mounted to slide in a pair of holes 136 within a housing 137, includes a lower surface formed as a ratchet 138. A compressible foot 138*a* is attached to a proximal end of bar 135, for engagement with a window opening surface 22. A bar-driving ratchet mechanism 139 is provided to extend the bar 135 in the direction of arrow 140. A bar-holding ratchet pawl 142 is provided to prevent the retraction of bar 135 in the direction opposite arrow 140.

Figure 14:
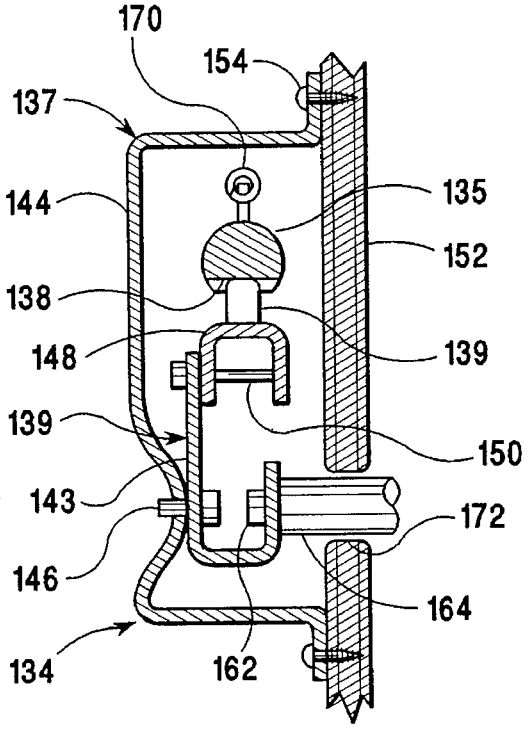
FIG. 14 is a cross-sectional elevation of a bar driving ratchet in the clamping mechanism of FIG. 13, taken as indicated by section lines XIV—XIV in FIG. 13.

FIG. 14 is a cross-sectional elevation, taken as indicated by section lines XIV—XIV in FIG. 13, to show bar-driving ratchet mechanism 139. A ratchet arm 143 is pivotally mounted to a rear side 144 of housing 137 by means of a rivet 146. A ratchet pawl 148 is pivotally mounted on ratchet arm 143 by means of a rivet 150.

Referring to FIGS. 13 and 14, the housing 137 is mounted to a window covering structure 152 by means of a number of screws 154. (While this covering structure 152 is shown in FIG. 14, it is not shown in FIG. 13, so that internal details of the alternative clamping mechanism 134 can be revealed). The limits of angular motion of ratchet arm 143 are established to be between a left stop tab 155 and a fight stop tabs 156 formed from the rear housing side 144. A driving pawl extension spring 158 is used to hold ratchet pawl 148 in contact with ratchet 138 while ratchet arm 143 is manually turned in the direction of arrow 159 toward right stop tab 156. A rectangular slot 160 at the pivot end of ratchet arm 143 is engaged by tip 162 of a removable crank 164. A holding pawl extension spring 168 holds ratchet pawl 142, which is pivotally mounted to rear housing side 144 by means of a rivet 169, in contact with ratchet 138. A bar return extension spring 170 provides a force tending to move bar 135 in a retraction direction opposite arrow 140.

The alternate clamping mechanism 134 is operated after a shutter, including the mechanism 134 and a window coveting structure 152, is placed in a window opening in the manner of shutter 10, as previously described relative to FIGS. 1 and 2. To begin the operation of the alterative clamping mechanism 134, the tip 162 of removable crank 164 is inserted, from outside the shutter, through drive hole 172 in window covering structure 152 to engage ratchet arm 143 through slot 160. The arm 143 is then driven in the direction of arrow 159 by the crank 164, with pawl 148 held in engagement with ratchet 138, so that bar 135 is driven in the direction of arrow 140. A number of such motions with crank 164 may be used to drive bar 135 in the direction of arrow 140 far enough to engage window opening surface 22 with compressible foot 138*a*. During a partial return motion of crank 164 opposite in direction from arrow 159, between each driving motion in the direction of arrow 159, the bar 135 returns opposite the direction of arrow 140 until the motion of a tooth in ratchet 138 is stopped by bar stopping pawl 142, In this way the motions produced by the sequential movement of arm 143 are allowed to have a generally accumulative effect.

The clamping mechanism 134 is subsequently disengaged by turning ratchet arm 143, by means of removable crank 164, in the direction opposite that of arrow 159 to come into contact with left stop 155. As this motion occurs, the upper surface of pawl 148 comes into contact with drive pawl release tab 173 formed from rear housing surface 144, causing the pawl 148 to be rotated downward, against the force supplied by extension spring 158, out of contact with ratchet 138. Also, as this motion of ratchet arm 143 in the direction opposite arrow 159 occurs, holding pawl release tab 174, formed as an integral portion of ratchet arm 143, contacts release tab 175, formed as an integral portion of bar-holding ratchet pawl 142, causing this pawl 142 to be pivoted in the direction of arrow 176 against the force supplied by extension spring 168. In this way, pawl 142 is disengaged from ratchet 138.

When an external torque is not applied to ratchet arm 143, for example, when the removable crank 164 is not inserted into aperture 160, the forces applied by extension springs 158 and 168 hold the respective pawls 148 and 142 in engagement with ratchet 138.

Figure 15:
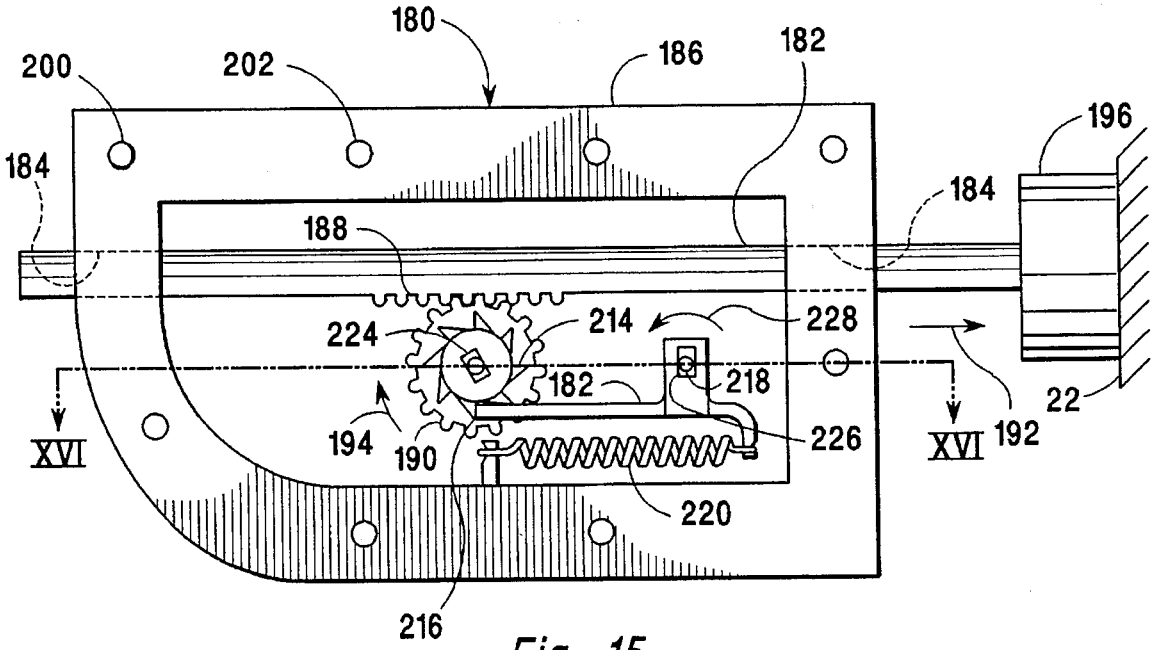
FIG. 15 is a front elevational view of a second alternate clamping mechanism for a shutter.
Figure 16:
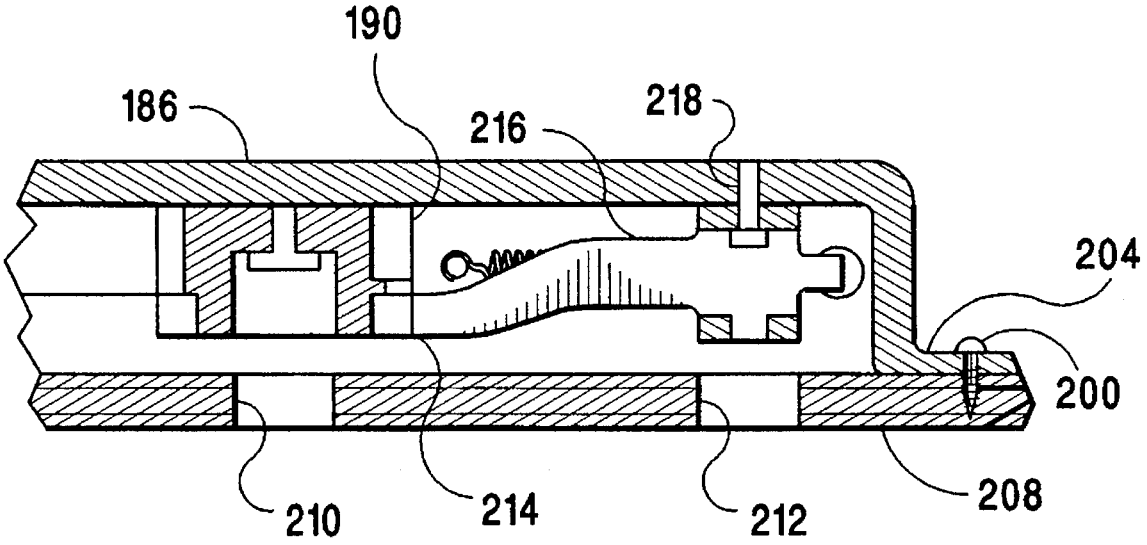
FIG. 16 is a cross-sectional elevation of a bar driving gear and a gear clamping pawl in the clamping mechanism of FIG. 15, taken as indicated by section lines XVI—XVI in FIG. 15.

FIGS. 15 and 16 show a second alternate clamping mechanism 180, with FIG. 15 being a front elevational view of the mechanism, while FIG. 16 is a cross-sectional elevation taken as indicated by section lines XVI–XVI in FIG. 15. To allow various internal components to be shown, FIG. 15 depicts the mechanism as removed from an associated window covering structure.

Referring to FIGS. 15 and 16, bar 182, mounted to slide in holes 184 of housing 186, has a lower portion formed into a rack 188 engaged by a drive gear 190, so that the bar 182 is slid in the direction of arrow 192 as gear 190 is turned in the direction of arrow 194. An elastomeric foot 196 is provided at an end of bar 182 to be compressed upon contact with a window opening surface 22. Housing 186 is mounted, by means of screws 200 extending through holes 202 in flange 204, to extend behind a window covering structure 208, in which holes 210 and 212 are formed to provide access for the engagement and disengagement of the mechanism. A ratchet wheel 214, turning with drive gear 190 as an integral part, engages a pawl 216, pivotally mounted to housing 186 by means of a rivet 218. Pawl 216 is held in engagement with ratchet wheel 214 by means of an extension spring 220, limiting particularly the return motion of bar 182, in the direction opposite arrow 192, after the compression of elastomeric foot 196 against window opening surface 22. Drive gear 190 has a non-circular aperture 224, allowing the engagement of a removable crank 164, (as shown in FIG. 14) after the insertion of the tip 162 of this crank through hole 210. Pawl 216 has a similar non-circular aperture 226, allowing the engagement of removable crank 164 after the insertion of the tip 162 of this crank through hole 212. Thus, the removable crank 164 is used to engage elastomeric foot 196 with a window surface 22 by turning drive gear 190 in the direction of arrow 194, and subsequently to allow the disengagement of elastomeric foot 196 from window opening surface 22 by rotating pawl 216 in the direction of arrow 228.

The preceding discussion has described embodiments of the present invention in which a bar is fed from a clamping mechanism by means of a drive mechanism, to engage a window opening surface. After the mechanism is engaged with the window opening surface in this way, the bar is held in place by a bar holding mechanism. In each of these embodiments, the bar may be fed through a variable distance, since both the drive mechanism and the holding mechanism can engage the bar at various points along its length. In the first clamping mechanism 20, discussed in reference to FIGS. 1–5, the bar drive mechanism uses an inclined plate 50, operating as a clutch, to engage the bar, and the bar holding mechanism uses another inclined plate 62, operating as a brake, to hold the bar in an extended position. In the alternate clamping mechanism 134, discussed in reference to FIGS. 13 and 14, the bar drive mechanism includes a ratchet pawl 148 engaging a ratchet 138, formed along a surface of the bar 135, and the holding mechanism includes a second ratchet pawl 142, also engaging the ratchet 138. In the second alternate clamping mechanism 180, discussed in reference to FIGS. 15 and 16, the bar drive mechanism includes a drive gear 190 engaging a rack 188, formed along a surface of the bar 182, and the bar holding mechanism includes a pawl 216 engaging a ratchet wheel 214.

In each of the embodiments described above, the bar drive mechanism is operable from outside the window covering structure, and the bar holding mechanism is releasable from outside the window covering structure. In the first clamping mechanism 20, discussed in reference to FIGS. 1–5, and in the alternate clamping mechanism 134, discussed in reference to FIGS. 13 and 14, the bar drive mechanism is operated by turning a crank, inserted through a hole in the window covering structure, in a first direction, and the bar holding mechanism is subsequently released by turning the crank, inserted through the same hole, opposite this first direction. In the second alternate clamping mechanism 180, described in reference to FIGS. 15 and 16, the bar drive mechanism is operated by turning a crank inserted through a first hole in the window covering structure, and the bar holding mechanism is subsequently released by turning the crank inserted through a second hole in the window covering structure.

A screw mechanism may alternately be used to drive a bar or an elastomeric foot into contact with a window surface. Clamping mechanisms of this type will now be discussed with reference to FIGS. 17–23.

Figure 17:
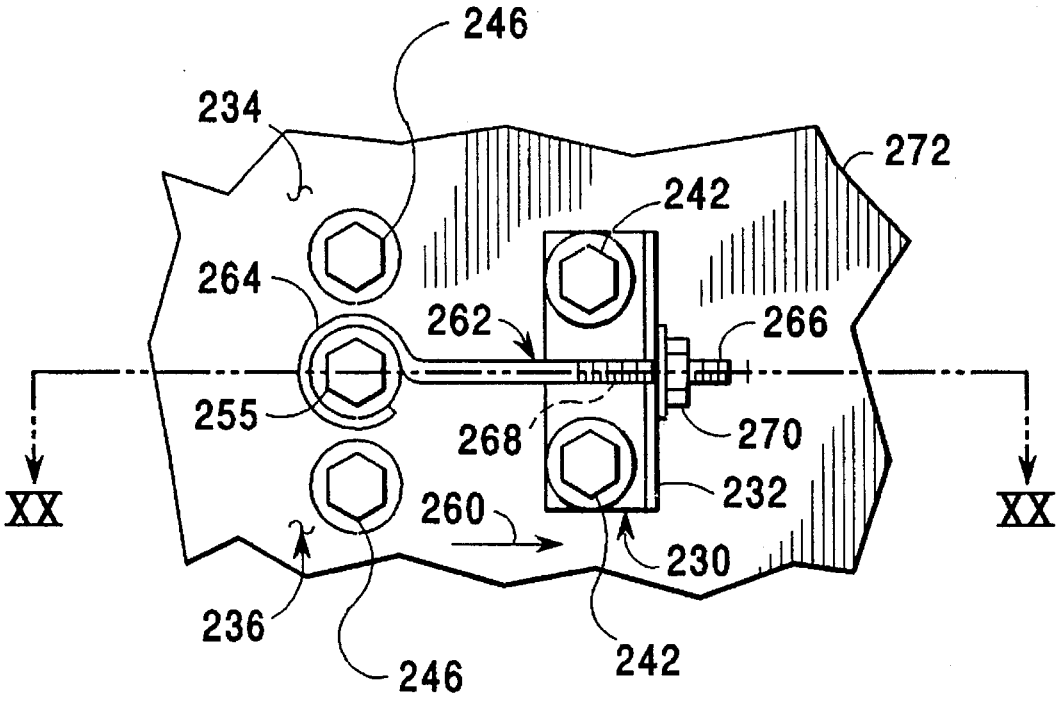
FIG. 17 is a front elevational view of a third alternate clamping mechanism for a shutter.
Figure 18:
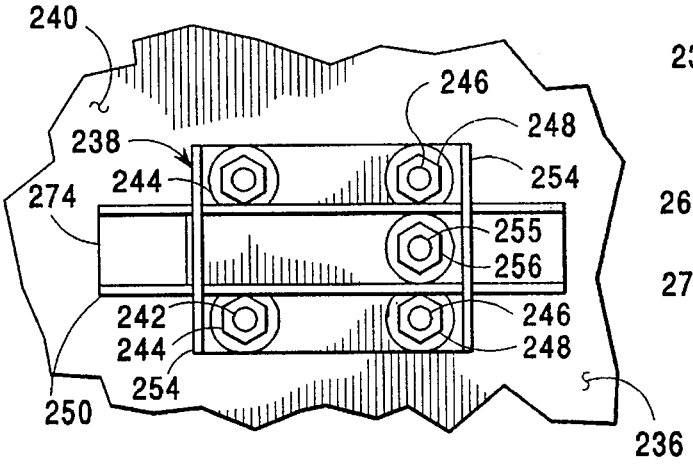
FIG. 18 is a rear elevational view of the clamping mechanism of FIG. 17.
Figure 19:
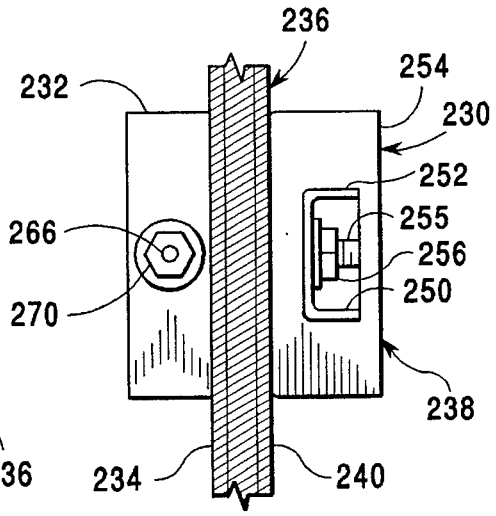
FIG. 19 is an end elevational view of the clamping mechanism of FIG. 17.
Figure 20:
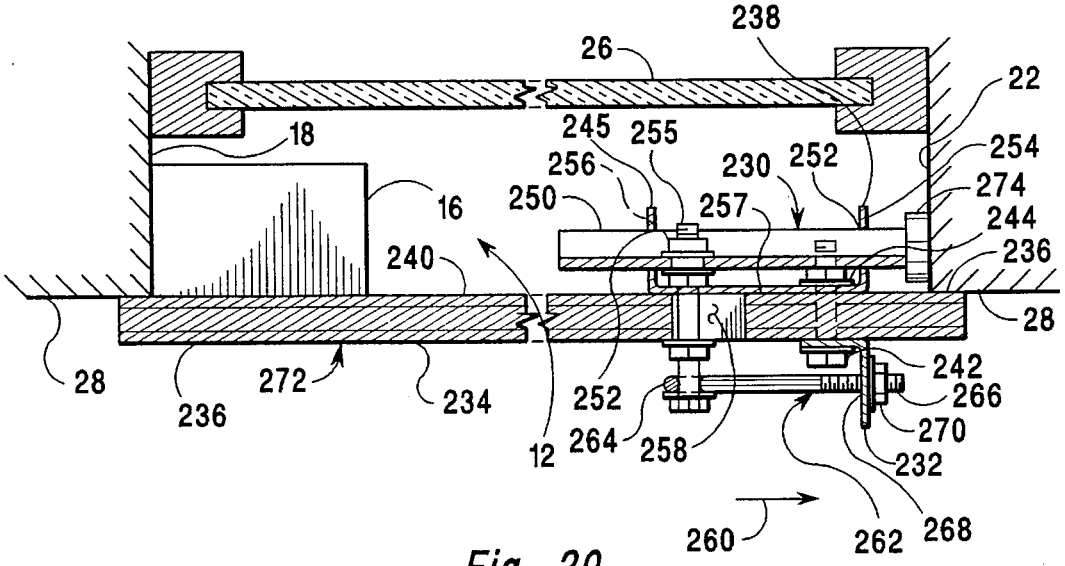
FIG. 20 is a cross-sectional plan view of the clamping mechanism of FIG. 17, taken as indicated by section lines XX—XX in FIG. 17.

FIGS. 17–20 show a third alternate clamping mechanism 230. FIG. 17 is a front elevational view of this mechanism, while FIG. 18 is a rear elevational view, FIG. 19 is an end elevational view, and FIG. 20 is a cross-sectional plan view taken as indicated by section lines XX—XX in FIG. 17.

Referring to FIGS. 17–20, third alternate clamping mechanism 230 includes an outer bracket 232, fastened to extend outward from an outer surface 234 of a window covering structure 236, and an inner bracket 238, fastened to extend inward from an inner surface 240 of structure 236. A first pair of screws 242 and nuts 244 are used to fasten outer bracket 232 and inner bracket 238 in place on opposite sides of window covering structure 236. A second pair of screws 246 and nuts 248 are additionally used to fasten inner bracket 238 in place inside structure 236. A movable bar 250, shaped as a channel, is used to perform the clamping function of the movable bars previously described within other clamping mechanisms. This bar 250 slides within a pair of rectangular holes 252 in the ends 254 of inner bracket 238. A shoulder screw 255, fastened to bar 250 by means of a nut 256 extends outward, through a slot 257 in inner bracket 238, and through a slot 258 in window covering structure 236, to be pulled in the direction of arrow 260 by means of an "eye" bolt 262. "Eye" bolt 262 includes a formed end 264 extending around shoulder screw 255 and a threaded end 266 extending through a clearance hole 268 in outer bracket 32. A nut 270 engages threaded end 266 of "eye" bolt 262, so that the tightening of nut 270 moves "eye" bolt 262, and thereby shoulder screw 255 and movable bar 250, in the direction of arrow 260.

Referring particularly to FIG. 20, third alternate clamping mechanism 30 is used in the general manner of clamping mechanism 20 (shown in FIG. 1), as window covering structure 236 is placed outside a window opening 12 in the general manner of window covering structure 14 (also shown in FIG. 1). Window covering structure 236 preferably overextends the window opening 12, overlapping portions of outer wall surfaces 28. One or more clamping blocks 16, fastened to window covering structure 236 is clamped against a first side 18 of window opening 12, as bar 250 is clamped against second side 22 of window opening 12.

Thus, a shutter 272, including the third alternate clamping mechanism 230 and window covering structure, is held in place, with inner bracket 238 and clamping block 16 extending into a window opening 12, as nut 270 is turned with a wrench (not shown), to move "eye" bolt 262 and shoulder screw 255 in the direction of arrow 260. This process continues until significant resistance to movement is encountered as a compressible foot 274 of movable bar 250 comes into contact with window opening surface 22, and as clamping block 16 is clamped against window opening surface 18. From this point, additional tightening of nut 270 may be employed to generate compressive forces holding the shutter in place. Subsequently, shutter 272 can be removed after the clamping mechanism 230 is disengaged by turning nut 270 in a reverse direction to move bar 250 in the direction opposite arrow 260.

Figure 21:
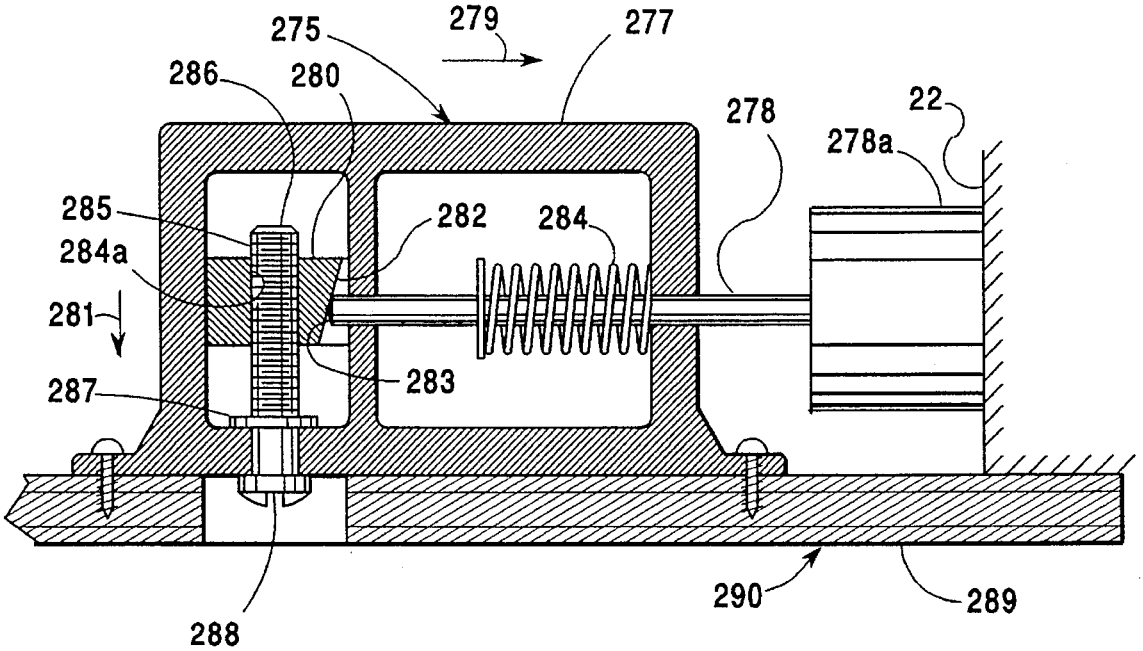
FIG. 21 is a front elevational view of a fourth alternate clamping mechanism.
Figure 22:
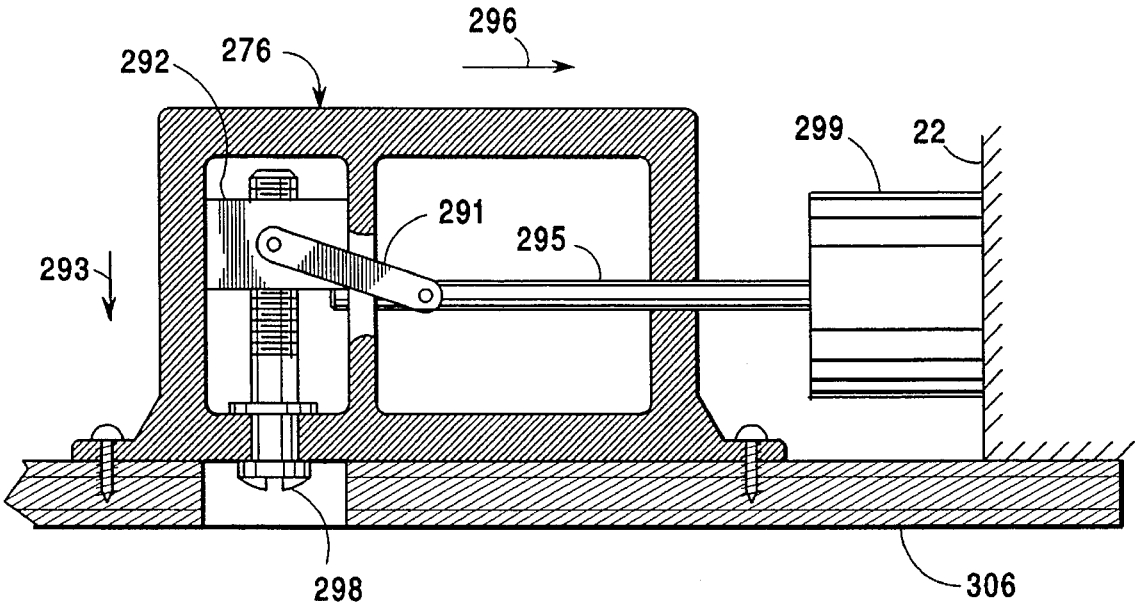
FIG. 22 is a front elevational view of a fifth alternate clamping mechanism.

FIGS. 21 and 22 are cross-sectional plan views of a fourth alternate clamping mechanism 275 and a fifth alternate clamping mechanism 276, respectively. In each of these clamping mechanisms 275 and 276, a drive screw is mounted to extend inward, with a screw head being operable from outside the window covering structure, and with a mechanism inside the window covering structure converting motion occurring along the axis of the drive screw into motion of a movable bar to engage or disengage a window opening surface.

Referring to FIG. 21, fourth alternate clamping mechanism 275 includes a housing 277, in which a bar 278 with a compressible foot 278*a* is mounted to slide in the engagement direction of arrow 279, and in which a drive block 280 is mounted to slide in an outward direction 281. Drive block 280 includes an inclined surface 282 sliding against a spherical surface 283 of bar 278. Surface 283 is held against surface 282 by means of a compression spring 284 pushing bar 278 in the direction opposite arrow 279. Drive block 280 includes an internally threaded hole 284a engaging a threaded surface 285 of a drive screw 286. Drive screw 286 is preferably of a captive type held in housing 277 with a clip 287. The head of drive screw 286 includes a non-circular cavity (not shown) or a slot 288 allowing the screw to be turned from outside window coveting structure 289 with a screwdriver (not shown). Thus, after a shutter assembly 290, including fourth alternate clamping mechanism 275 and window coveting structure 289, is installed at a window opening, the rotation of screw 288 in one direction is used to effect the engagement of bar 273 with window surface 22, and the rotation of screw 288 in an opposite direction is subsequently used to effect the disengagement of bar 273.

Referring to FIG. 22, fifth alternative clamping mechanism 276 is similar to fourth alternate clamping mechanism 275 (shown in FIG. 21), except that the inclined plane mechanism of clamping mechanism 275 is replaced by a slider-crank mechanism including a drive link 291 pivotally mounted at each end, extending between a block 292 sliding in engagement direction 293 and a bar 295 mounted to slide in the direction of arrow 296. As the block 292 is moved in the direction of arrow 293 by turning a drive screw 298, drive link 291 is rotated toward a position of alignment with bar 295, pushing bar 295 in the direction of arrow 296. Thus the processes of engaging and disengaging clamping mechanism 276 are similar to the processes of engaging and disengaging clamping mechanism 275, described above in reference to FIG. 21. A particular advantage is provided by mechanism 276, in that a very high engagement force at compressible foot 299 can be obtained as the mechanism approaches the condition in which link 291 and bar 295 are aligned. Furthermore, a spring (such as spring 284 of FIG. 21) is not required to effect the disengagement of bar 295 from window opening surface 22.

Figure 23:
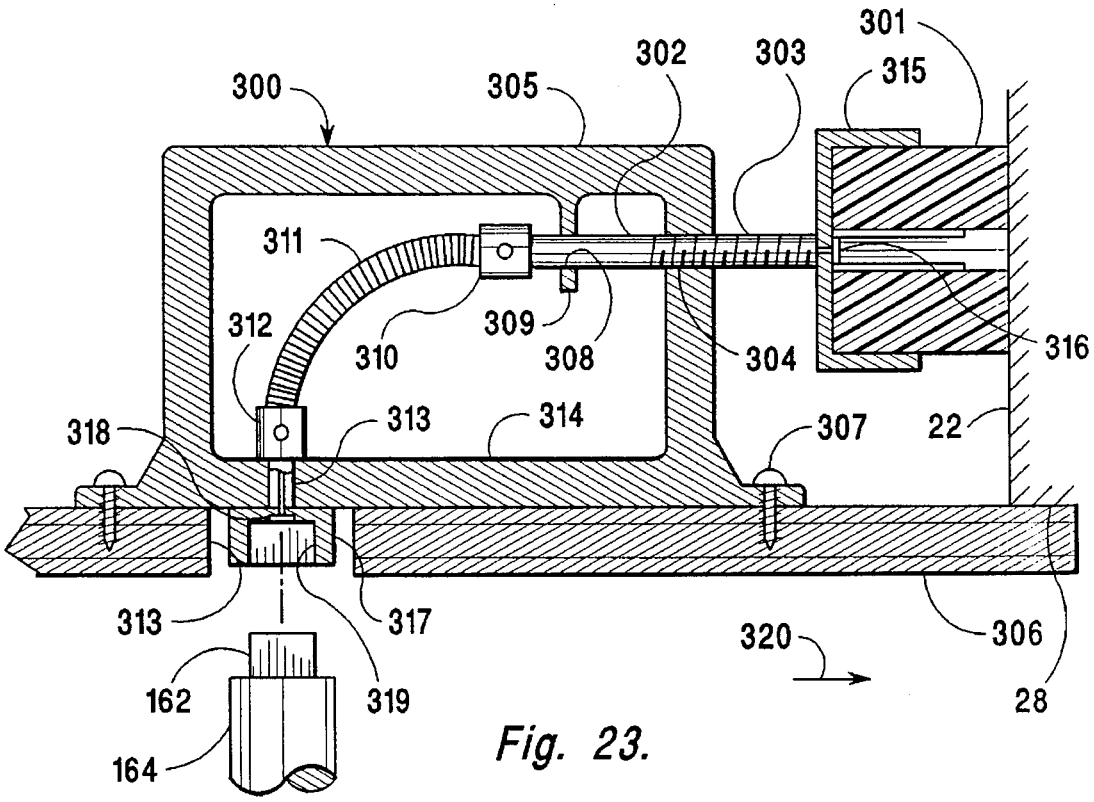
FIG. 23 is a cross-sectional plan view of a sixth alternate clamping mechanism.

FIG. 23 is a cross-sectional plan view of a sixth alternate clamping mechanism 300, having a compressible foot 301 driven into engagement with window opening surface 22 by means of the rotation of a drive screw shaft 302 including an externally threaded surface 303 engaging an internally threaded hole 304 in a housing 305 fastened to a window covering structure 306 by means of a number of screws 307. The shaft 302 is furthermore rotatably mounted in a support hole 308 extending through an inner wall 309 of housing 305. Within housing 305, an end of drive screw shaft 302 is connected, through a coupling 310, to a flexible cable 311, which is of the general type typically used to drive a speedometer. This type of cable readily transmits rotary motion while allowing flexure. At the other end of flexible cable 311, a coupling 312 is rotatably mounted in a hole 313 extending through a front surface 314 of housing 305. Compressible foot 301 is mounted to the outward-extending end of drive screw shaft 302 by a method allowing rotation of the shaft 302 without concurrent rotation of the foot 301. Specifically, compressible foot 301 is held by a cup 315, which is rotatably mounted on the end of shaft 302 with a rivet 316. At the other end of flexible cable 311, coupling 312 is rigidly mounted to an outer coupling 317, extending into a clearance hole 313 in window coveting structure 306, by means of a rivet 318. Outer coupling 317 includes a non-circular aperture 319, which can be engaged by a non-circular tip portion 162 of removable crank 164.

Thus, compressible foot 301 is moved in the engagement direction of arrow 320, and in the retraction direction opposite arrow 320, by the rotation of drive screw 302, which may be in turn brought about from outside the window coveting structure 306 through the rotation of removable crank 164 in engagement with outer coupling 317.

The preceding four embodiments, or versions of the present invention, which have been discussed in reference to FIGS. 17–23, are examples of shutters using clamping mechanisms in which a bar is driven into and out of engagement with a window opening surface by means of a drive screw. In the first of these examples, as shown in FIGS. 17–20, the motion of a drive screw in the form of eye bolt 262 is carried from outside window covering structure 236 by means of a screw 255 extending within a slot 258 of the structure 238. In the examples discussed in reference to FIGS. 21 and 22, the rotary motion of a screw having a head accessible from outside the window coveting structure is converted into a motion sliding the bar. In the example discussed in reference to FIG. 23, the rotary motion of outer coupling 317 is transmitted to a drive screw shaft 302, which also slides as a bar to clamp compressible foot 301 against window opening surface 22.

Examples of embodiments or versions of the present invention using the toggle principle will now be discussed, with particular references being made to FIGS. 24–29. In each such embodiment or version, as the shutter is installed at the window opening, a toggle arm is brought into engagement in such a way that pulling the end to the shutter having the mechanism outward, away from the window opening, causes the toggle arm to be driven past an over-center position at which energy storage within the mechanism is maximized.

Figure 24:
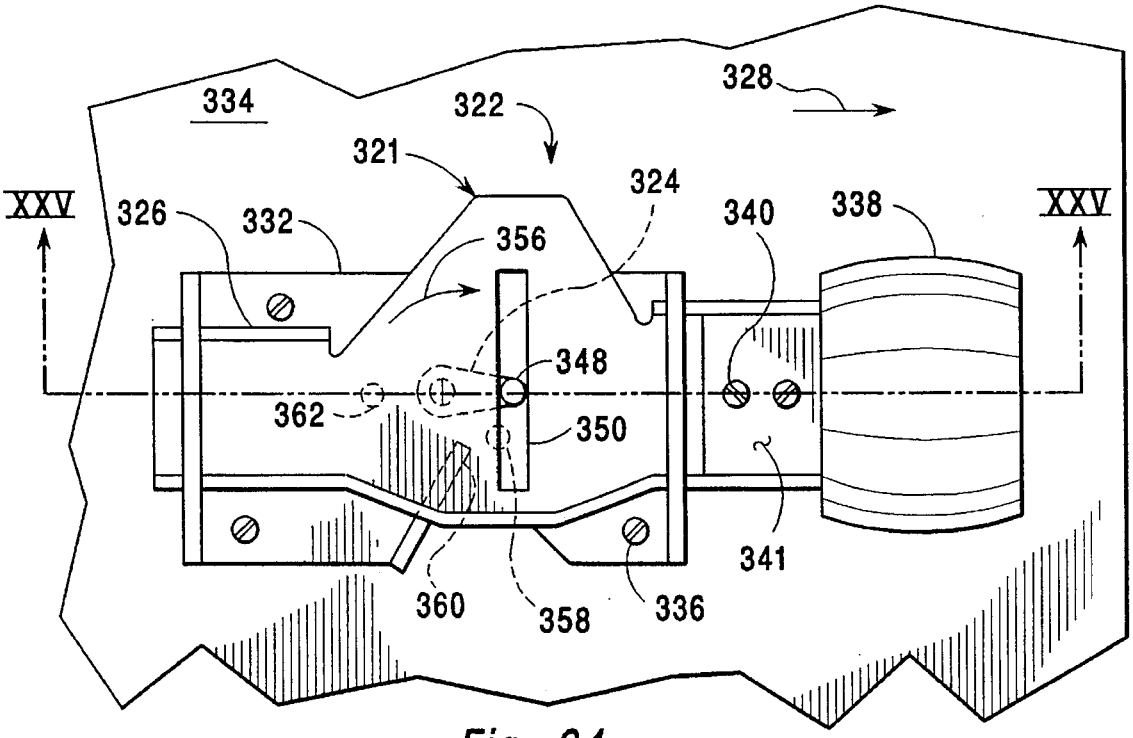
FIG. 24 is a rear elevational view of a seventh alternate clamping mechanism.
Figure 25:
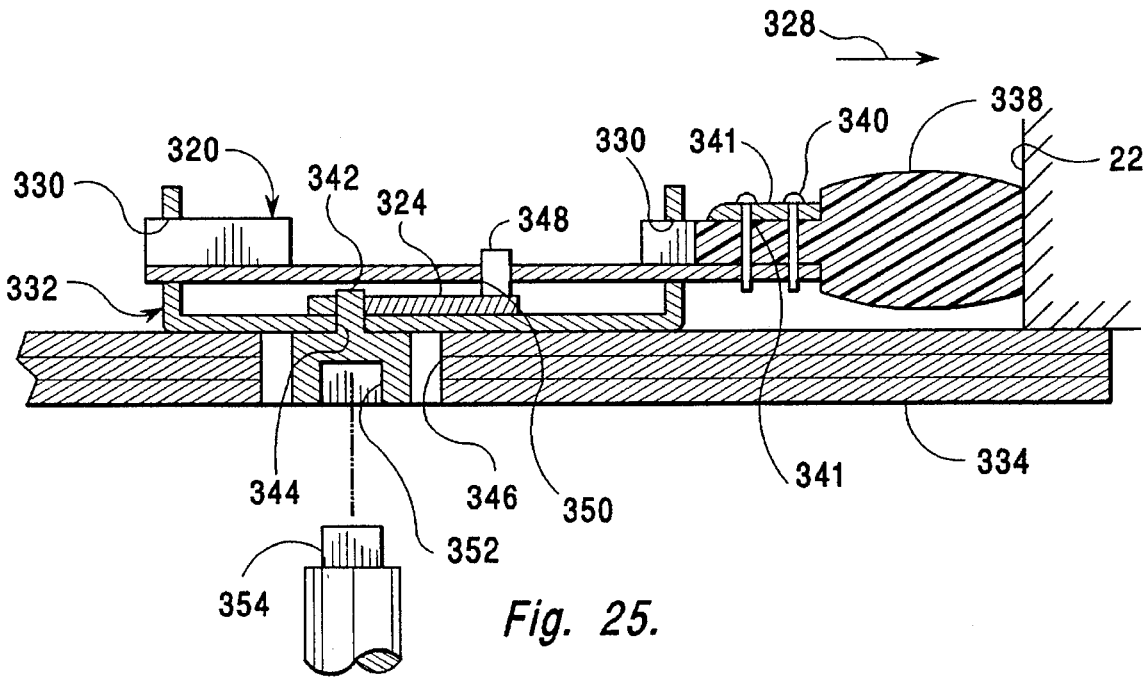
FIG. 25 is a cross-sectional plan view of the clamping mechanism of FIG. 24, taken as indicated by section lines XXV—XXV in FIG. 24.

FIGS. 24 and 25 are views of a seventh alternate clamping mechanism 321, employing a scotch yoke 322 driven by a toggle arm 324. FIG. 24 is a elevational view of this clamping mechanism 321 from inside, while FIG. 25 is a cross-sectional plan view taken as indicated by cross-section lines XXV—XXV in FIG. 24.

Referring to FIGS. 24 and 25, a sliding bar 326, formed from a plate including a driven portion of a scotch yoke 322, is mounted to slide in the direction of arrow 328 through a pair of holes 330 in a mounting bracket 332, which is fastened to a window covering structure 334 by means of a number of screws 336. A compressible foot 338 is fastened to sliding bar 326 by means of screws 340 and a clamping plate 341. Toggle arm 324, which is attached to turn with a drive coupling 342 extending through a bearing hole 344 in mounting bracket 332, and through clearance hole 346 in window covering structure 334, includes a drive pin 348 sliding within a slot 350 in sliding bar 326 to form the scotch yoke mechanism 322. Drive coupling 342 includes a non-circular aperture 352, which is engaged by a removable drive crank 354 to rotate toggle arm 324. While slot 350 is shown as a straight slot extending perpendicular to the direction of motion indicated by arrow 328, it is understood that slot 350 can be inclined or curved to modify the characteristics of the mechanism through which force and displacement are applied to sliding bar 326.

In FIGS. 24 and 25, toggle arm 324 and drive pin 348 are shown in the position affording a maximum extension of sliding bar 326 in the direction of arrow 328, and hence a maximum level of compression of compressible foot 338. To take advantage of the properties of a toggle mechanism, in the process of installing the shutter, toggle arm 324 is rotated in the direction of arrow 356 past the angle at which it is shown, to an angle in which drive pin 348 is indicated by dashed line 358. A stopping tab 360, formed as a part of mounting bracket 332, prevents further rotation of toggle arm 324 in the direction of arrow 356. From this position of maximum rotation in the direction of arrow 356, the rotation of toggle arm 324 in the direction opposite arrow 356 is resisted, due to the fact that such rotation would increase the compression of compressible foot 38, which acts as the spring structure of a toggle mechanism. However, the shutter may subsequently be removed by rotating toggle arm 324 opposite the direction of arrow 356. When drive pin 348 is in the position indicated by dashed line 362, a maximum clearance is achieved between compressible foot 328 and the adjacent window opening surface 22.

Figure 26:
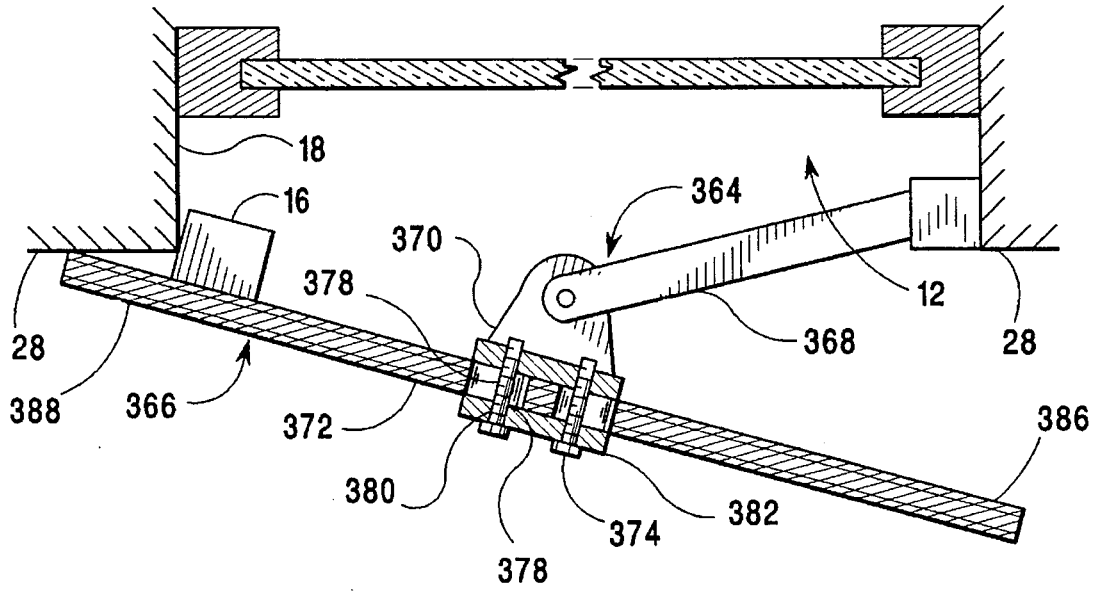
FIG. 26 is a partially cross-sectional plan view of a shutter having a eighth alternate clamping mechanism, before completion of an installation process.
Figure 27:
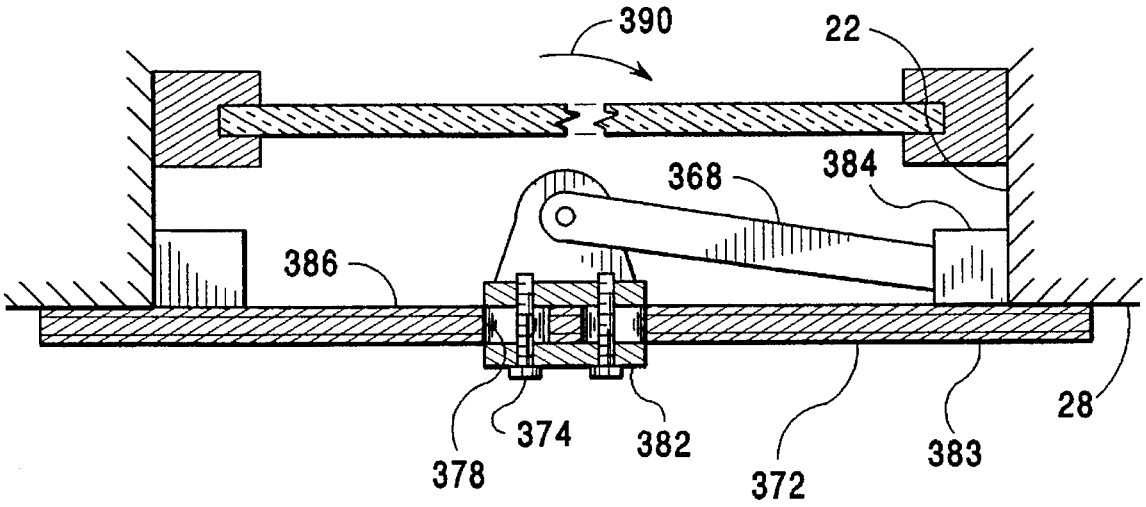
FIG. 27 is a partially cross-sectional plan view of the shutter having the clamping mechanism of FIG. 26, after completion of the installation process.

FIGS. 26 and 27 are cross-sectional plan views of a eighth alternate clamping mechanism 364, which like seventh alternate clamping mechanism 321, makes use of a toggle principle to hold a shutter in place. FIG. 26 shows the shutter 366 as the process of installing it at a window opening 12 is begun, while FIG. 27 shows the shutter 366 fully installed at the window opening.

Referring to FIG. 26, a toggle arm 368 is pivotally mounted to a bracket 370, which is in turn attached to a window covering structure 372 by means of screws 374 extending through slots 378 in structure 372 and clearance holes 380 in a clamping plate 382. The end of toggle arm 368 includes a compressible foot 384. In the process of installing, compressible foot 384 is brought into contact with window opening surface 22, with the adjacent end 386 of window covering structure 372 held outward from wall surface 28, with the opposite end 388 held against outer wall surface 28, and with clamping block 16 against an opposite window opening surface 18.

Referring to FIG. 27, the installation of shutter 366 is completed as the gap between window covering structure end 386 and wall surface 28 is closed. During the process of closing this gap, toggle arm 368 rotates in the direction of arrow 390, with minimal slippage occurring between compressible foot 384 and the adjacent window opening surface 22, due to the frictional properties of the elastomeric material of which compressible foot is composed. This rotation takes toggle arm 368 past the "center" position providing maximum compression of compressible foot 384 against window opening surface 22. Therefore, after the gap between wail surface 28 and end 386 of window covering structure 372 is closed, any attempt to pull this end 386 outward, away from the wail surface 28, is met with increasing resistance, as the compression of foot 384 is increased. The toggle mechanism is subsequently released, to allow the removal of shutter 366 from the window opening, by loosening the screws 374 holding bracket 370 in place.

The preceding two embodiments or versions of the present invention, described in reference to FIGS. 24–27, employ clamping mechanisms requiring the movement of a pivot arm through the "over-center" position as the shutter is installed. In the case of the embodiment or version of FIGS. 24 and 25, the pivot arm 324 is rotated through the "over-center" position using a crank, while, in the case of the embodiment or version of FIGS. 26 and 27, the pivot arm 368 is moved through the "over-center" position as the shutter is pushed into its installation position.

A ninth alternate clamping mechanism, which uses the physical resistance developed as a toggle mechanism, is driven toward an "over-center" position to hold a shutter in place, without requiting that the toggle mechanism be driven through an "over-center position" during the installation process, will now be discussed in reference to FIG. 28, which is a partially cross-sectional plan view of a shutter using this mechanism.

Figure 28:
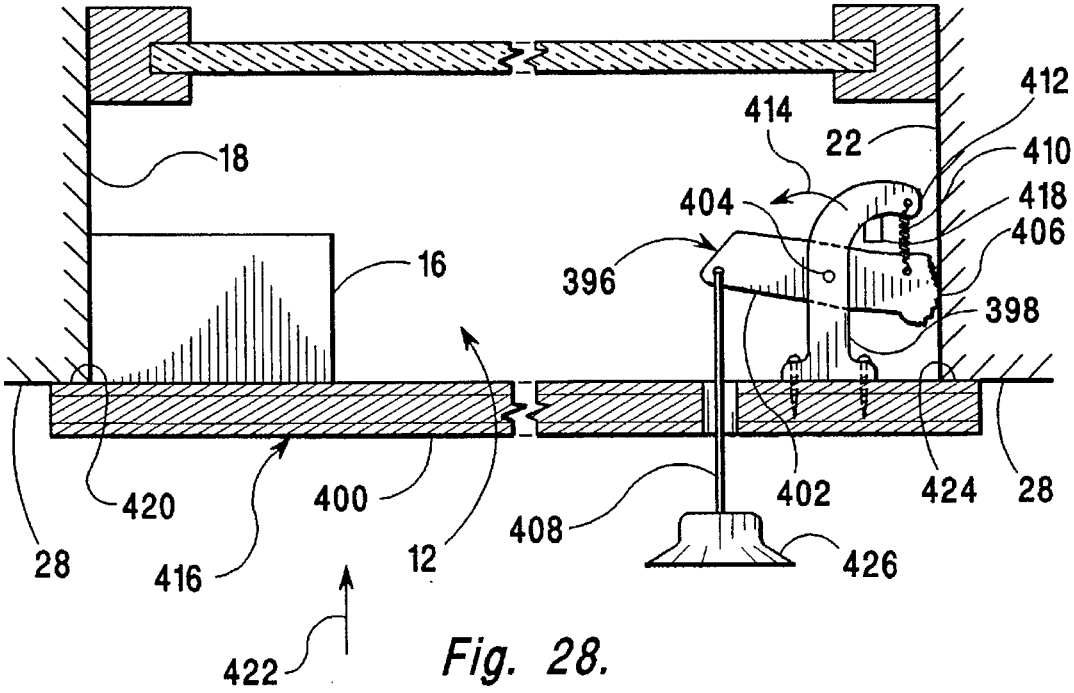
FIG. 28 is a partially cross-sectional plan view of a shutter having a ninth alternate clamping mechanism.

Thus, referring to FIG. 28, a ninth alternate clamping mechanism 396 includes a bracket 398 fastened to a window coveting structure 400. A pivot arm 402 is pivotally mounted on the bracket 398 by means of a pin 404. A shoe 406 is formed at one end of pivot arm 402, while a push-rod 408 is pivotally attached at the opposite end of the pivot arm. An extension spring 410, extending between pivot arm 402 and a tab portion 412 of bracket 398 provides a torque operating on pivot arm 402 in the direction of arrow 414. Before the shutter 416 is installed into the window opening, the angle through which extension spring 410 pulls pivot arm 402 is limited by contact between the arm 402 and a stop portion 418 of bracket 398. This stop position 418 is preferably located to hold pivot arm 402 at the "over-center" position causing maximum compression of compressible shoe 406.

In the installation process, shutter 416 may be, for example, rotated into place, with block 16 in contact with window opening surface 18, and with an end 420 of window covering structure in contact with outer wall surface 28. Alternately, shutter 416 may be slid inward in the direction of arrow 422. In either case, during the installation process, the frictional properties of compressible foot 406 against window opening surface 22 cause pivot arm 402 to rotate opposite the direction of arrow 414, against the torque provided by extension spring 410. After the installation process is complete, with end 424 of window covering structure against outer wall surface 28, the torque provided by extension spring 410 remains available to hold shoe 406 in compression against wall surface 22. Any attempt to pull end 424 away from wall surface 28 is met with increasing resistance as pivot arm 402 is rotated in the direction of arrow 414 toward an "over-center" position.

Shutter 416 may be removed from window opening 12 after this clamping mechanism 396 is disengaged by pushing push rod 408, from outside the window covering structure 416 by means of knob 426 until compressible foot 406 is brought out of contact with window opening surface 22.

Figure 29:
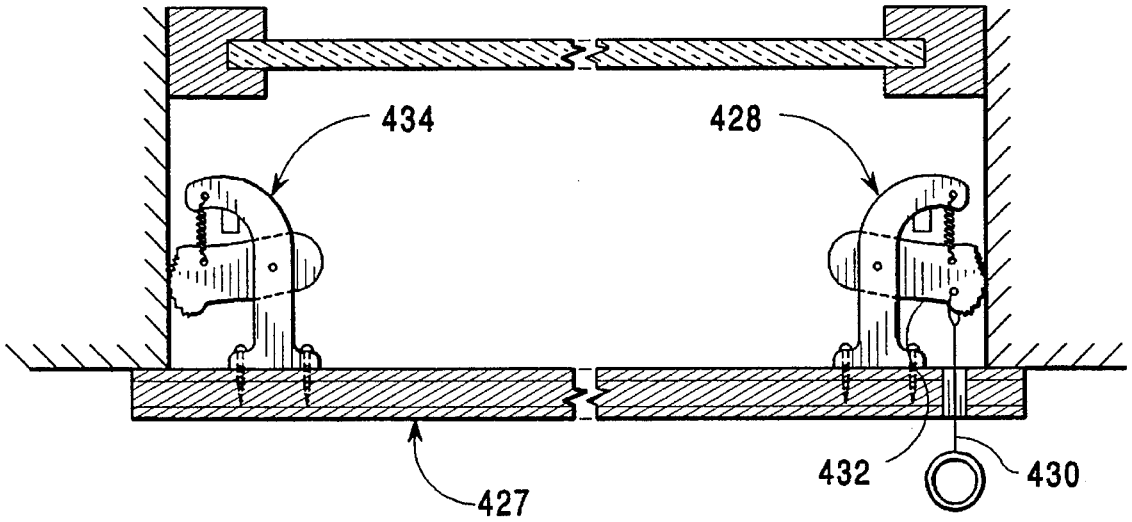
FIG. 29 is a partially cross-sectional plan view of a shutter having the clamping mechanism of FIG. 28 on each side of a window opening.

FIG. 29 is a partly cross-sectional plan view of a shutter 427 using a mechanism of the general type discussed above in reference to FIG. 28 on each side of a window opening. This configuration is particularly useful, as the ability of this type of mechanism to resist forces attempting to move the shutter outward is provided at the two opposite sides of the window opening. One clamping mechanism 428 is provided with a release capability through pulling a cord 430, which is shown as an alternative to push rod 408 (shown in FIG. 28), being fastened to the same side of pivot arm 432 as extension spring 410. The other clamping mechanism 434 is not provided with a release capability of this kind, since it may be easily releases by movement of the shutter 427 after the release of clamping mechanism 428.

While two clamping mechanisms are shown in FIG. 29, it is understood that additional clamping mechanisms can be used to hold a shutter in place on a particularly large window. For example, two clamping mechanisms 428 with a release capability may be used on one side of the window opening, while two clamping mechanisms 434 without the release capability are used on the other side of the window opening.

The clamping mechanisms discussed above in reference to FIGS. 28 and 29 provide increased force resisting the outward removal of the shutter due to the increased engagement of the pivot arm 402 with the associated window opening surface 22 as the arm 402 is rotated toward the over-center position. This increased engagement results from the movement of shoe 406 at the end of arm 402 in an arc centered at pivot pin 404.

Figure 30:
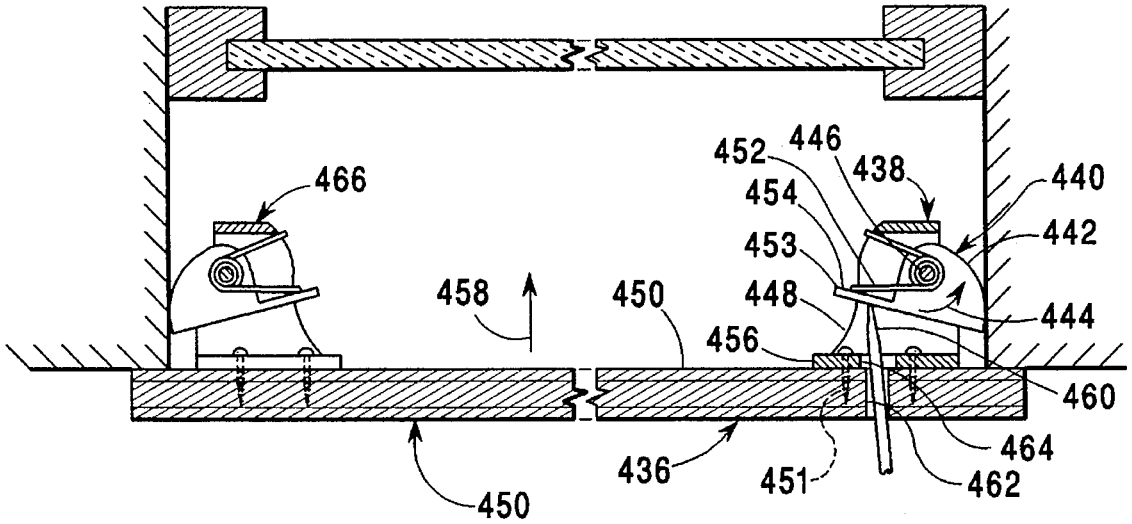
FIG. 30 is a partly cross-sectional view of a shutter having a variation of the ninth alternate clamping mechanism of FIG. 28.

FIG. 30 is a partly cross-sectional plan view of a shutter 436 including a variation of the ninth alternate clamping mechanism 396 (shown in FIG. 28). In clamping mechanism 438 of shutter 436, a pivoting cam 440 is used in place of the pivot arm 402 (shown in FIG. 28) of clamping mechanism 396. Pivoting cam 440 has a contact surface 442 which is curved to enhance the effect of increased engagement as the cam 440 is rotated in the direction of arrow 444 about a pivot pin 446. Pin 446 is mounted in a housing 448, which is in turn attached to window covering structure 450 by means of screws 451.

A torsion spring 452 applies a torque on pivoting cam 440 in the direction of arrow 444. Thus, before the shutter 436 is installed in window opening 12, pivoting cam 440 is held rotated in this direction, with end 453 of tab portion 454 resting against the base 456 of housing 448. As the shutter 436 is pushed inward, in the direction of arrow 458, the engagement of contact surface 442 with window opening surface 22 causes the rotation of pivoting cam opposite the direction of arrow 444, effectively decreasing the engagement of the pivoting cam 440 with window surface 22. A subsequent attempt to remove shutter 436 outward, in the direction opposite arrow 458, is resisted by increased engagement force as the engagement is increased by the rotation of cam 440 in the direction of arrow 444. The shutter 436 may then be removed by pushing tab portion 454 with a screwdriver tip 460, for example, inserted through clearance hole 462 in window covering structure 450 and hole 464 in housing 448.

As generally described above in reference to FIG. 29, a second clamping mechanism 466 may be used to clamp similarly against a window opening surface 18. A clearance hole corresponding to clearance hole 462 may be provided, but is not generally needed, since clamping mechanism 438 may be completely disengaged before the process is disengaging second clamping mechanism 466.

Figure 31:
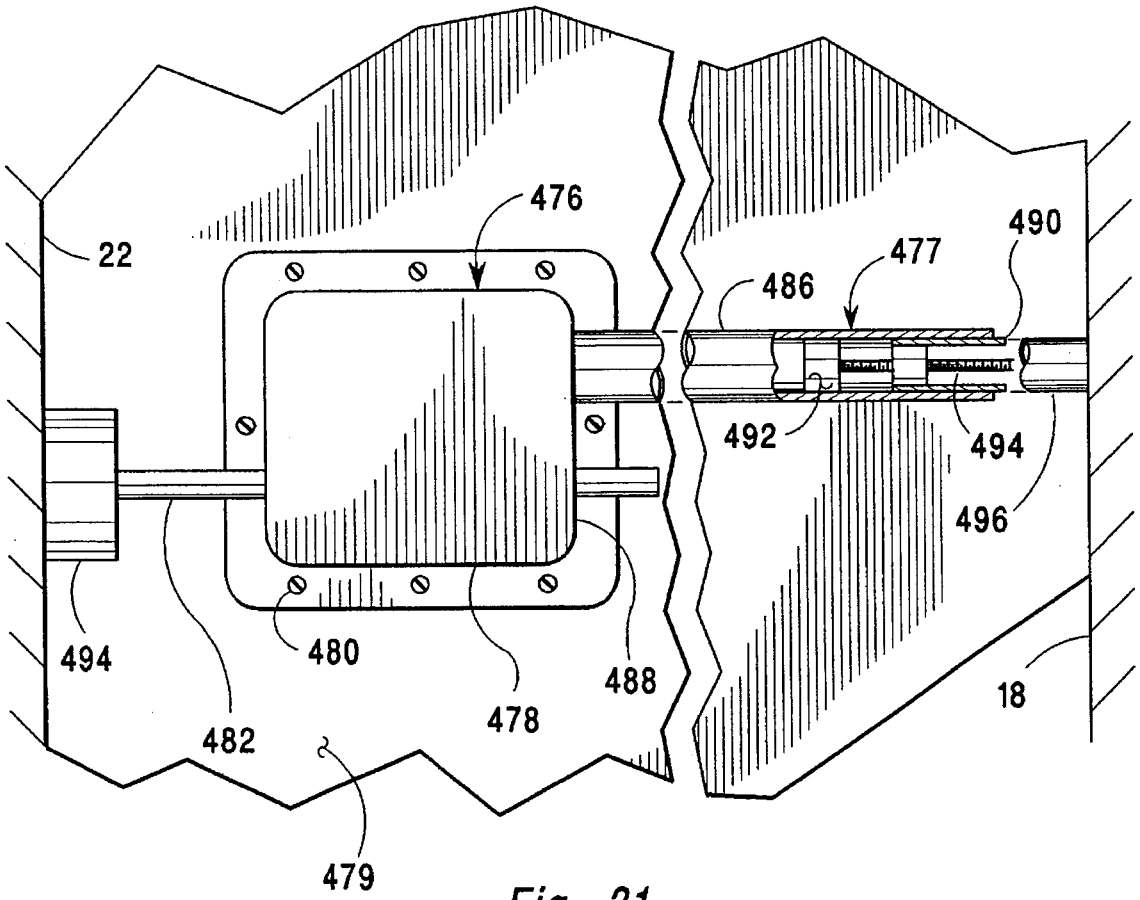
FIG. 31 is an inside elevational view of a shutter having an adjustable, telescoping stop mechanism.

FIG. 31 is a partly cross-sectional rear elevational view of a clamping mechanism 476 including a telescoping tube 477 for clamping against first window opening surface 18. Housing 478, which is fastened to a window covering structure 479 by means of screws 480, includes a mechanism for clamping against second window surface 22 by means of a movable bar 482 and a compressible foot 484. The mechanism within this housing 478 may be, for example, one of the several mechanisms described above. A stationary tube 486 extends from an end 488 of housing 478. A movable tube 490 extends within stationary tube 486. A mounting block 492, rigidly fastened within stationary tube 486, supports an externally threaded shaft 494 extending along the axis of tube 486. An end block 496, rigidly fastened within movable tube 490, includes an internally threaded hole engaging the threaded surface of shaft 494.

In this way, a mechanism for engaging the two window opening sides is provided, with an adjustable structure extending from the side of the housing 478 opposite to the engagement direction of movable bar 482. The telescoping arrangement of tubes 486 and 490 provides an adjustment allowing the same clamping mechanism 476 to be used for window openings varying significantly in width. This adjustment is performed, when needed, before the shutter 498 is installed on a window opening, by turning movable tube 580, which then moves inward or outward through stationary tube 486, in engagement with threaded shaft 494.

Various embodiments of the present invention include devices which are turned by a removable device, such as a removable crank or a screwdriver, in order to engage or disengage the clamping mechanism. It is understood that various means powered, for example, with electricity or air pressure, can also be used to effect such rotation without departing from the spirit and scope of the invention.

While the invention has been described in its preferred form or embodiment with some degree of particularity, it is understood that this description has been given only by way of example and that numerous changes in the details of construction, fabrication and use, including the combination and arrangement of parts, may be made without departing from the spirit and scope of the invention.

What is claimed is:

1. A shutter for covering a window opening extending inward from a wall Surface, wherein said window opening includes a first window opening surface extending inward at a first side thereof and a second window opening surface extending inward at a second side thereof, and wherein said shutter comprises:

a substantially solid window covering structure for extending across said window opening, said window covering structure having an inner side and an outer side;

first engagement means extending from said inner side for engaging said first window opening surface; and second engagement means for engaging said second window opening surface, wherein said second engagement means includes movable engagement means extending inside said inner side to be moved through a variable distance into engagement with said second window opening surface, wherein movement is imparted to said movable engagement means from outside said outer side, wherein said movable engagement means is held in engagement with said second window opening surface, maintaining an engagement force between said movable engagement means and said second window opening surface after said movable engagement means is moved into engagement with said second window opening surface, wherein said movable engagement means is released from engagement with said second window opening surface from outside said outer side, wherein said movable engagement means includes a bar, extending within said inner side, slidably mounted to move in an engagement direction into engagement with said second window opening surface; and wherein said second engagement means additionally includes driving means for moving said bar in said engagement direction, holding means for holding said bar engaged with said second window opening surface, and releasing means for releasing said holding means to allow motion of said bar opposite said engagement direction, said driving means and said releasing means being operable from outside said outer side.

2. The shutter of claim 1:

wherein said driving means includes a drive plate and a drive crank, said drive plate having a bar driving aperture through which said bar extends, said drive plate being pivotable between a bar driving position, in which an edge of said bar driving aperture frictionally engages said bar to drive said bar in said engagement direction, and a bar drive releasing position, in which said bar can freely slide through said bar driving aperture, said drive plate being held by a first spring in said bar drive releasing position, said drive crank being rotatable in a drive direction in engagement with an edge portion of said drive plate while holding said drive plate in said bar driving position and while moving said drive plate in said engagement direction;

wherein said holding means includes a holding plate with a bar holding aperture through which said bar extends, said holding plate being pivotable between a bar holding position, in which an edge of said bar holding aperture frictionally engages said bar, preventing motion of said bar opposite said engagement direction, and a bar releasing position, in which said bar can freely slide through said bar holding aperture, said holding plate being held in said bar holding position by a second spring; and wherein said releasing means moves said holding plate into said bar releasing position.

3. The shutter of claim 2, wherein said drive crank is rotatable opposite said drive direction, out of engagement with said edge portion of said drive plate, to move said releasing means so that said holding plate moves into said bar releasing position.

4. The shutter of claim 1, wherein said driving means includes:

a drive crank, pivotable about a crank rotation center, having a sector gear extending along a pitch arc forming as a portion of a circle centered at said crank rotation center, a removable crank including an drive engagement tip and a drive gear; and a cylindrical support surface into which said drive engagement tip may be inserted from outside said outer surface through an aperture in said window covering structure with said drive gear meshing with said sector gear.

5. The shutter of claim 1, wherein said driving means includes:

a drive crank pivotable about a crank rotation center, having a non-circular aperture in line with said crank rotation center; and a removable crank including a non-circular tip engaging said non-circular aperture, said crank being removably engageable with said drive crank from outside said outer surface through an aperture in said window covering structure.

6. The shutter of claim 1:

wherein said driving means includes a clamping plate and a drive crank, said clamping plate having a bar clamping aperture through which said bar extends, said clamping plate being pivotable between a first inclined angle at which said bar is clamped by said clamping aperture, an intermediate position at which said bar is released by said clamping aperture, and a second inclined angle at which said bar is clamped by said clamping aperture, said clamping plate being additionally slidable in said engagement direction, said drive crank being rotatable in a drive direction in engagement with said clamping plate, as said clamping plate is rotated from said first inclined angle to said second inclined angle, and as said clamping plate is additionally slid in said engagement direction;

wherein said holding means includes a pawl engaging said drive crank to hold said drive crank rotated in said drive direction; and wherein said releasing means includes means for releasing said pawl from engagement with said drive crank.

7. The shutter of claim 1:

wherein said driving means includes a ratchet extending along said bar, a pivotally mounted drive crank and a drive pawl engaging said ratchet to drive said bar in said engagement direction as said drive crank is rotated in a drive direction;

wherein said holding means includes a holding pawl engaging said ratchet; and wherein said releasing means includes means for moving said drive pawl and said holding pawl out of engagement with said ratchet.

8. The shutter of claim 7, wherein said releasing means includes:

a stationary drive pawl disengaging tab moving said drive pawl out of engagement with said ratchet when said drive crank is rotated opposite said drive direction; and a release arm extending to move said holding pawl out of engagement with said ratchet when said drive crank is rotated opposite said drive direction.

9. The shutter of claim 1:

wherein said driving means includes a rack extending along said bar and a gear rotatably mounted to mesh with said rack;

wherein said holding means includes a ratchet turning with said gear and a pawl held in engagement with said gear to prevent motion of said bar opposite said engagement direction; and wherein said release means includes means for moving said pawl out of contact with said ratchet.

10. The shutter of claim 9:

wherein said gear includes a first non-circular aperture;

wherein said pawl includes a second non-circular aperture; and wherein said second engagement means includes a removable crank removably engaging said first and second non-circular apertures, from outside said outer surface, by means of a non-circular tip of said crank, through clearance apertures in said window covering structure.

11. A shutter for covering a window opening extending inward from a wall surface, wherein said window opening includes a first window opening surface extending inward at a first side thereof and a second window Opening surface extending inward at a second side thereof, and wherein said shutter comprises:

a substantially, solid window covering structure for extending across said window opening, said window covering structure having an inner side and an outer side;

first engagement means extending from said inner side for engaging said first window opening surface; and second engagement means for engaging said second window opening surface, wherein said second engagement means includes movable engagement means extending inside said inner side to be moved through a variable distance into engagement with said second window opening surface, wherein said second engagement means includes a drive screw mechanism for converting rotary motion in a drive direction to translation of said movable engagement means in an engagement direction, an inner bracket extending inward from said inner side, with said movable engagement means slidably mounted on said inner bracket to move in said engagement direction, an outer bracket extending outward from said outer side, with said drive screw mounted on said outer bracket, and transfer means extending through an aperture in said window covering structure, between said drive screw mechanism and said movable engagement means, to transfer motion therebetween, wherein movement is imparted to said movable engagement means from outside said outer side, wherein said movable engagement means is held in engagement with said second window opening surface, maintaining an engagement force between said movable engagement means and said second window opening surface after said movable engagement means is moved into engagement with said second window opening surface, and wherein said movable engagement means is released from engagement with said second window opening surface from outside said outer side.

12. The shutter of claim 11:

wherein said transfer means comprises a post extending from said movable engagement means through a clearance aperture in said window covering structure; and wherein said screw drive comprises an eye bolt with an externally threaded surface at a threaded end and a loop at an end opposite said threaded end, with said threaded end extending through an aperture in said outer bracket to engage a drive nut, with said loop extending around said post.

13. A shutter for covering a window opening extending inward from a wall surface, wherein said window opening includes a first window opening surface extending inward at a first side thereof and a second window opening surface extending inward at a second side thereof, and wherein said shutter comprises:

a substantially solid window covering structure for extending across said window opening, said window covering structure having an inner side and an outer side;

first engagement means extending from said inner side for engaging said first window opening surface; and second engagement means for engaging said second window opening surface, wherein said second engagement means includes movable engagement means extending inside said inner side to be moved through a variable distance into engagement with said second window opening surface, a drive screw mechanism for converting rotary motion in a drive direction to translation of said movable engagement means in an engagement direction, wherein said drive screw mechanism includes a screw, with an axis extending perpendicularly to said engagement direction and a screw head accessible from outside said window covering structure, and a block sliding perpendicularly to said engagement direction in engagement with said screw; wherein said second engagement means additionally includes means for transmitting motion of said block to said movable engagement means, wherein movement is imparted to said movable engagement means from outside said outer side, wherein said movable engagement means is held in engagement with said second window opening surface, maintaining an engagement force between said movable engagement means and said second window opening surface after said movable engagement means is moved into engagement with said second window opening surface, and wherein said movable engagement means is released from engagement with said second window opening surface from outside said outer side.

14. A shutter for covering a window opening extending inward from a wall surface, wherein said window opening includes a first window opening surface extending inward at a first side thereof and a second window opening surface extending inward at a second side thereof, and wherein said shutter comprises:

a substantially solid window covering structure for extending across said window opening, said window covering structure having an inner side and an outer side;

first engagement means extending from said inner side for engaging said first window opening surface; and second engagement means for engaging said second window opening surface, wherein said second engagement means includes movable engagement means extending inside said inner side to be moved through a variable distance into engagement with said second window opening surface, a drive mechanism including a drive screw for converting rotary motion in a drive direction to translation of said movable engagement means in an engagement direction, a housing extending inward from said inner side, said housing holding said drive screw to extend therefrom toward said second window opening surface, said housing including an internally threaded portion engaging an externally threaded portion of said drive screw so that said drive screw is driven in said engagement direction as said drive screw is rotated in said drive direction, a drive coupling rotatably mounted at said window covering structure, said drive coupling including an outward-directed noncircular aperture accessible through an aperture in said window covering structure; and a flexible shaft fastened at a first end to said drive coupling at an end opposite said first end to said drive screw, whereby rotary motion is transferred between said drive coupling and said drive shaft, wherein movement is imparted to said movable engagement means from outside said outer side, wherein said movable engagement means is held in engagement with said second window opening surface, maintaining an engagement force between said movable engagement means and said second window opening surface after said movable engagement means is moved into engagement with said second window opening surface, and wherein said movable engagement means is released from engagement with said second window opening surface from outside said outer side.

15. A shutter for covering a window opening extending inward from a wall surface, wherein said window opening includes a first window opening surface extending inward at a first side thereof and a second window opening surface extending inward at a second side thereof, and wherein said shutter comprises:

a substantially solid window coveting structure for extending across said window opening, said window covering structure having an inner side and an outer side;

first engagement means extending from said inner side for engaging said first window opening surface; and second engagement means for engaging said second window opening surface, wherein said second engagement means includes movable engagement means extending inside said inner side to be moved through a variable distance into engagement with said second window opening surface, a bracket extending inward from said inner side, a pivotable member pivotally mounted on said bracket, and an engagement surface for engaging said second window opening surface, with rotation of said pivotable member in a first direction of rotation increasing engagement of said engagement surface with said second window opening surface, and stopping means limiting rotation of said pivotable member opposite said first direction of rotation, wherein movement is imparted to said movable engagement means from outside said outer side, wherein said movable engagement means is held in engagement with said second window opening surface, maintaining an engagement force between said movable engagement means and said second window opening surface after said movable engagement means is moved into engagement with said second window opening surface, and wherein said movable engagement means is released from engagement with said second window opening surface from outside said outer side, wherein said movable engagement means additionally comprises a plate attached to a compressible foot, said plate being slidably mounted within said bracket to move in an engagement direction, said plate including a slot extending perpendicular to said engagement direction, wherein said pivotable member additionally includes a pin extending into said slot to move said movable engagement means in said engagement direction with rotation of said pivotable member; and wherein said stopping means extends from said bracket to limit motion of said pivotable member.

16. A shutter for covering a window opening extending inward from a wall surface, wherein said window opening includes a first window opening surface extending inward at a first side thereof and a second window opening surface extending inward at a second side thereof, and wherein said shutter comprises:

a substantially solid window covering structure for extending across said window opening, said window covering structure having an inner side and an outer side;

first engagement means extending from said inner side for engaging said first window opening surface; and second engagement means for engaging said second window opening surface, wherein said second engagement means includes movable engagement means extending inside said inner side to be moved through a variable distance into engagement with said second window opening surface, wherein said second engagement means includes a bracket extending inward from said inner side, a pivotable member pivotally mounted on said bracket, and an engagement surface for engaging said second window opening surface, with rotation of said pivotable member in a first direction of rotation increasing engagement of said engagement surface with said second window opening surface, and stopping means limiting rotation of said pivotable member opposite said first direction of rotation, wherein a compressible foot is attached at a first end of said pivotable member, wherein said pivotable member is pivotally mounted on said bracket at a distance sufficiently inward to allow movement of said pivotable member through an over-center position as said shutter is installed at said window opening with said compressible foot in contact with said second window opening surface, wherein said stopping means includes a portion of said window covering structure for contacting a portion of said wall surface adjacent said second window opening surface, wherein movement is imparted to said movable engagement means from outside said outer side, wherein said movable engagement means is held in engagement with said second window opening surface, maintaining an engagement force between said movable engagement means and said second window opening surface after said movable engagement means is moved into engagement with said second window opening surface, and wherein said movable engagement means is released from engagement with said second window opening surface from outside said outer side.

17. A shutter for covering a window opening extending inward from a wall surface, wherein said window opening includes a first window opening surface extending inward at a first side thereof and a second window opening surface extending inward at a second side thereof, and wherein said shutter comprises:

a substantially solid window covering structure for extending across said window opening, said window covering structure having an inner side and an outer side;

first engagement means extending from said inner side for engaging said first window opening surface; and second engagement means for engaging said second window opening surface, wherein said second engagement means includes movable engagement means extending inside said inner side to be moved through e variable distance into engagement with said second window opening surface, a bracket extending inward from said inner side, a pivotable member pivotally mounted on said bracket, an engagement surface for engaging said second window opening surface, wherein rotation of said pivotable member in a first direction of rotation increases engagement of said engagement surface with said second window opening surface, wherein said second engagement surface additionally includes a spring providing a torque rotating said pivotable member in said first direction of rotation, wherein said engagement surface is formed as a part of said pivotable member, wherein said second engagement means additionally includes stopping means limiting rotation of said pivotable member opposite said first direction of rotation, wherein movement is imparted to said movable engagement means from outside said outer side, wherein said movable engagement means is held in engagement with said second window opening surface, maintaining an engagement force between said movable engagement means and said second window opening surface after said movable engagement means is moved into engagement with said second window opening surface and wherein said movable engagement means is released from engagement with said second window opening surface from outside said outer side.

18. The shutter of claim 17, wherein said engagement surface is curved in a profile increasing engagement of said engagement surface with said second window opening surface as said pivotable member is rotated in said first direction of rotation.

19. A shutter for covering a window opening extending inward from a wall surface, wherein said window opening includes a first window opening surface extending inward at a first side thereof and a second window opening surface extending inward at a second side thereof, and wherein said shutter comprises:

a substantially solid window covering structure for extending across said window opening, said window covering structure having an inner side and an outer side;

first engagement means extending from said inner side for engaging said first window opening surface, wherein said first engagement means includes a first engagement bracket, a first shoe pivotally mounted at a first shoe pivot axis at said first engagement bracket, said first shoe including a first shoe contact surface for engaging said second window opening surface, said first shoe contact surface being offset toward said inner side from said first shoe pivot axis, a first stopping bracket pivotally mounted at a first bracket pivot axis at said first engagement bracket, said first stopping bracket including a first bracket contact surface for engaging said first window opening surface, said first bracket contact surface being offset from said first bracket pivot axis in a direction away from said inner side, first rotation limiting means for limiting pivoting motion of said first stopping bracket on said first engagement bracket, and means for transferring angular motion in a first shoe engaging direction from said first engagement bracket to said first shoe, wherein said motion in a first shoe engaging direction increases engagement of said first shoe in contact with said first window opening surface; and second engagement means for engaging said second window opening surface, wherein said second engagement means includes movable engagement means extending inside said inner side to be moved through a variable distance into engagement with said second window opening surface, wherein movement is imparted to said movable engagement means from outside said outer side, wherein said movable engagement means is held in engagement with said second window opening surface, maintaining an engagement force between said movable engagement means and said second window opening surface after-said movable engagement means is moved into engagement with said second window opening surface, and wherein said movable engagement means is released from engagement with said second window opening surface from outside said outer side.

20. A shutter for covering a window opening extending inward from a wall surface, wherein said window opening includes a first window opening surface extending inward at a first side thereof and a second window opening surface extending inward at a second side thereof, and wherein said shutter comprises:

a substantially solid window covering structure for extending across said window opening, said window covering structure having an inner side and an outer side;

first engagement means extending from said inner side for engaging said first window opening surface; and second engagement means for engaging said second window opening surface, wherein said second engagement means includes movable engagement means extending inside said inner side to be moved through a variable distance into engagement with said second window opening surface, wherein movement is imparted to said movable engagement means from outside said outer side, wherein said movable engagement means is held in engagement with said second window opening surface, maintaining an engagement force between said movable engagement means and said second window opening surface after said movable engagement means is moved into engagement with said second window opening surface, wherein said movable engagement means is released from engagement with said second window opening surface from outside said outer side, wherein said movable engagement means includes a bar including a proximal end extending in an engagement direction, a second shoe pivotally mounted at a second shoe pivot axis at said proximal end, said second shoe including a second shoe contact surface for engaging said second window opening surface, said second shoe contact surface being offset toward said inner side from said second shoe pivot axis, a second stopping bracket pivotally mounted at a bracket pivot axis at said proximal end, said second stopping bracket including a second bracket contact surface for engaging said second window opening surface, said second bracket contact surface being offset from said second bracket pivot axis in a direction away from said inner side, second rotation limiting means for limiting pivoting motion of said second stopping bracket on said bar, and means for transferring angular motion in a second shoe engaging direction from said second stopping bracket to said second shoe, wherein said motion in a shoe engaging direction increases engagement of said shoe in contact with said second window opening surface.

21. A shutter for covering a window opening extending inward from a wall surface, wherein said window opening includes a first window opening surface extending inward at a first side thereof and a second window opening surface extending inward at a second side thereof, and wherein said shutter comprises:

a substantially solid window covering structure for extending across said window opening, said window covering structure having an inner side and an outer side;

first engagement means extending from said inner side for engaging said first window opening surface, wherein said first engagement means includes a first engagement bracket extending inward from said inner side, a first engagement pivot arm pivotally mounted at a first engagement pivot point on said first engagement bracket, said first engagement pivot arm including a first engagement compressible foot at a proximal end for engaging said first window opening surface, a spring rotating said first engagement pivot arm in a direction moving said first engagement compressible foot away from said inner side, and a stop surface limiting motion of said first engagement compressible foot away from said inner side; and second engagement means for engaging said second window opening surface, wherein said second engagement means includes movable engagement means extending inside said inner side to be moved through a variable distance into engagement with said second window opening surface, wherein movement is imparted to said movable engagement means from outside said outer side, wherein said movable engagement means is held in engagement with said second window opening surface, maintaining engagement force between said movable engagement means and said second window opening surface after said movable engagement means is moved into engagement with said second window opening surface, and wherein said movable engagement means is released from engagement with said second window opening surface from outside said outer side.

22. A clamping mechanism for holding a shutter in place against a recessed window opening, wherein said clamping mechanism comprises:

a housing having a first side including an attached to said shuttle aperture a second side opposite said first side including a wall extending opposite said aperture, and a plurality of mounting features adjacent said aperture;

a bar mounted to slide within said housing in a direction parallel to said first side, said bar extending from said housing in an engagement direction;

bar drive means for driving said bar in said engagement direction, wherein said bar drive means is manually operable from said first side;

bar holding means for preventing motion of said bar in a direction opposite said engagement direction; and releasing means for releasing said bar holding means to allow motion of said bar in a direction opposite said engagement direction, wherein said releasing means is manually operable from said first side.

23. The clamping mechanism of claim 22:

wherein said bar drive means includes a drive crank and a drive plate, said drive crank being engaged for rotation through said aperture to pivot within said housing, said drive plate having a bar driving aperture through which said bar extends, said drive plate being pivotable between a bar driving position, in which an edge of said bar driving aperture frictionally engages said bar to drive said bar in said engagement direction, and a bar drive releasing position, in which said bar can freely slide through said bar driving aperture, said drive plate being held by a first spring in said bar drive releasing position, said drive crank being rotatable in a drive direction in engagement with an edge portion of said drive plate while holding said drive plate in said bar driving position and while moving said drive plate in said engagement direction; and wherein said bar holding means includes a holding plate with a bar holding aperture through which said bar extends, said holding plate being pivotable between a bar holding position in which an edge of said bar holding aperture frictionally engages said bar, preventing motion of said bar opposite said engagement direction, and a bar releasing position, in which said bar can freely slide through said bar holding aperture, said holding plate being held in said bar holding position by a second spring; and wherein said releasing means moves said holding plate into said bar releasing position as said drive crank is rotated opposite said drive direction.

24. The clamping mechanism of claim 22:

wherein said bar drive means includes a drive crank, a drive pawl, and a ratchet extending along a surface of said bar, said drive crank being engaged for rotation through said aperture to pivot within said housing, said drive pawl engaging said ratchet as to drive said bar in said engagement direction as said drive crank is rotated in a drive direction;

wherein said bar holding means includes a holding pawl engaging said ratchet; and wherein said releasing means moves said holding pawl and said drive pawl out of engagement with said ratchet as said drive crank is rotated opposite said drive direction.

25. The clamping mechanism of claim 22:

wherein said bar drive means includes a gear and a rack extending along a surface of said bar in engagement with said gear, said gear being engaged for rotation through said aperture to turn within said housing;

wherein said holding means includes a ratchet wheel turning with said gear and a ratchet pawl engaging said ratchet wheel; and wherein said releasing means includes surfaces of said ratchet pawl, engageable through said aperture, for moving said pawl out of engagement with said ratchet wheel.

26. A clamping mechanism for holding a shutter in place against a recessed window opening, wherein said shutter includes a window covering structure extending across said window opening, and wherein said clamping mechanism comprises:

an inner bracket for mounting on an inner surface of said window covering structure;

a bar mounted to slide in an engagement direction within said inner bracket;

an outer bracket for mounting on an outer surface of said window covering structure;

a screw drive mechanism operating on said outer bracket; and transfer means for transferring sliding motion between said screw drive mechanism and said bar.

27. The clamping mechanism of claim 26:

wherein said screw drive mechanism comprises an eye bolt, and a nut, said eye bolt having a threaded portion at one end and a loop at an end opposite said threaded portion, said eye bolt extending through an aperture in said outer bracket to engage said nut; and wherein said transfer means includes a post fastened to said bar, fitting within said loop.

* * * * *